US006644448B2

(12) United States Patent
Bernbaum et al.

(10) Patent No.: US 6,644,448 B2
(45) Date of Patent: Nov. 11, 2003

(54) SOFT-SIDED CARRYING CASE

(75) Inventors: L. Harrison Bernbaum, Lake Forest, IL (US); Scott A. Vermillion, Chicago, IL (US)

(73) Assignee: High Sierra Sport Company, Vernon Hills, IL (US)

( * ) Notice: Subject to any disclaimer, the term of this patent is extended or adjusted under 35 U.S.C. 154(b) by 0 days.

(21) Appl. No.: 09/759,683

(22) Filed: Jan. 12, 2001

(65) Prior Publication Data

US 2002/0023812 A1 Feb. 28, 2002

Related U.S. Application Data

(60) Provisional application No. 60/227,214, filed on Aug. 23, 2000.

(51) Int. Cl.[7] ..... A45C 3/00; A45C 13/00

(52) U.S. Cl. ..... 190/111; 190/18 A; 190/115; 190/114; 190/903; 190/124; 190/126

(58) Field of Search ..... 190/109, 111, 190/114, 18 A, 124, 115, 125, 126, 127, 900, 901, 902, 25

(56) References Cited

U.S. PATENT DOCUMENTS 476,598 A * 6/1892 Bancroft ..... 190/109 X
495,448 A * 4/1893 Young ..... 190/109
745,133 A * 11/1903 Axelman ..... 190/109 X
752,756 A * 2/1904 Christie ..... 190/109
792,183 A * 6/1905 Tiderman ..... 190/111 X
1,473,932 A * 11/1923 Gotisar ..... 190/114 X
1,502,987 A * 7/1924 Glass et al. ..... 190/111
2,055,657 A * 9/1936 Gordon ..... 190/114 X
2,420,150 A * 5/1947 Riess ..... 190/119
3,744,601 A * 7/1973 Doppelt ..... 190/114 X
4,054,191 A * 10/1977 Schoenfield ..... 190/114
4,236,657 A * 12/1980 Brunton ..... 190/111 X
4,366,886 A * 1/1983 Tawill ..... 190/44
4,374,555 A * 2/1983 March ..... 190/48
4,418,806 A * 12/1983 Johnson ..... 190/111
4,932,506 A * 6/1990 Kim ..... 190/111
5,209,328 A * 5/1993 Kotkins, Jr. ..... 190/111 X
5,590,771 A * 1/1997 Cota ..... 190/114 X
5,951,037 A * 9/1999 Hsieh et al. ..... 280/638 X

* cited by examiner

*Primary Examiner*—Tri M. Mai
(74) *Attorney, Agent, or Firm*—Marshall, Gerstein & Borun LLP

(57) ABSTRACT

A soft-sided carrying case having pivotable upper compartments is disclosed. The soft-sided carrying case includes a lower compartment, with the lower compartment including a plurality of sidewalls, a top wall and a bottom wall. A first upper compartment is provided, with the first upper compartment having a plurality of sidewalls, a top wall, and a bottom wall, and with the first upper compartment pivotally meeting the lower compartment along a first line of intersection. A second upper compartment is disclosed, with the second upper compartment having a plurality of sidewalls, a top wall, and a bottom wall, and with the second upper compartment pivotally meeting the first upper compartment along a second line of intersection. The first and second upper compartments are both pivotable about their respective lines of intersection between folded positions in which the first and second upper compartments overlie the lower compartment and unfolded positions.

15 Claims, 19 Drawing Sheets

SOFT-SIDED CARRYING CASE

RELATED APPLICATIONS

This application claims domestic priority from an earlier filed U.S. provisional application, Ser. No. 60/227,214, filed Aug. 23, 2000.

FIELD OF THE INVENTION

The present invention relates to soft-sided carrying cases. More specifically, the present invention relates to a soft-sided carrying case having a number of compartments, with at least some of the compartments being shiftable between folded and unfolded positions.

BACKGROUND OF THE INVENTION

Soft-sided luggage or soft-sided carrying cases are generally well known in the art. Soft-sided carrying cases typically offer one or more distinct advantages over conventional luggage. For example, soft-sided luggage is typically lighter weight than conventional luggage, it can typically be carried using a shoulder strap, it typically includes external pockets that can be accessed without completely opening the case, and, if it is well built, it is less prone to damage from improper handling.

Despite the popularity of known soft-sided carrying cases or luggage, there is a continuing need for improved soft-sided luggage.

BRIEF DESCRIPTION OF THE DRAWINGS

Certain features and advantages in the apparatus disclosed and claimed herein will become apparent to those skilled in the art from the following detailed descriptions and the accompanying drawings, in which:

DETAILED DESCRIPTION OF THE PREFERRED EMBODIMENTS

The following description of the preferred embodiments is not intended to limit the scope of the invention to the precise forms disclosed, but instead is intended to be illustrative of the principles of the invention so that others skilled in the art may follow its teachings.

Figures 1, 4:
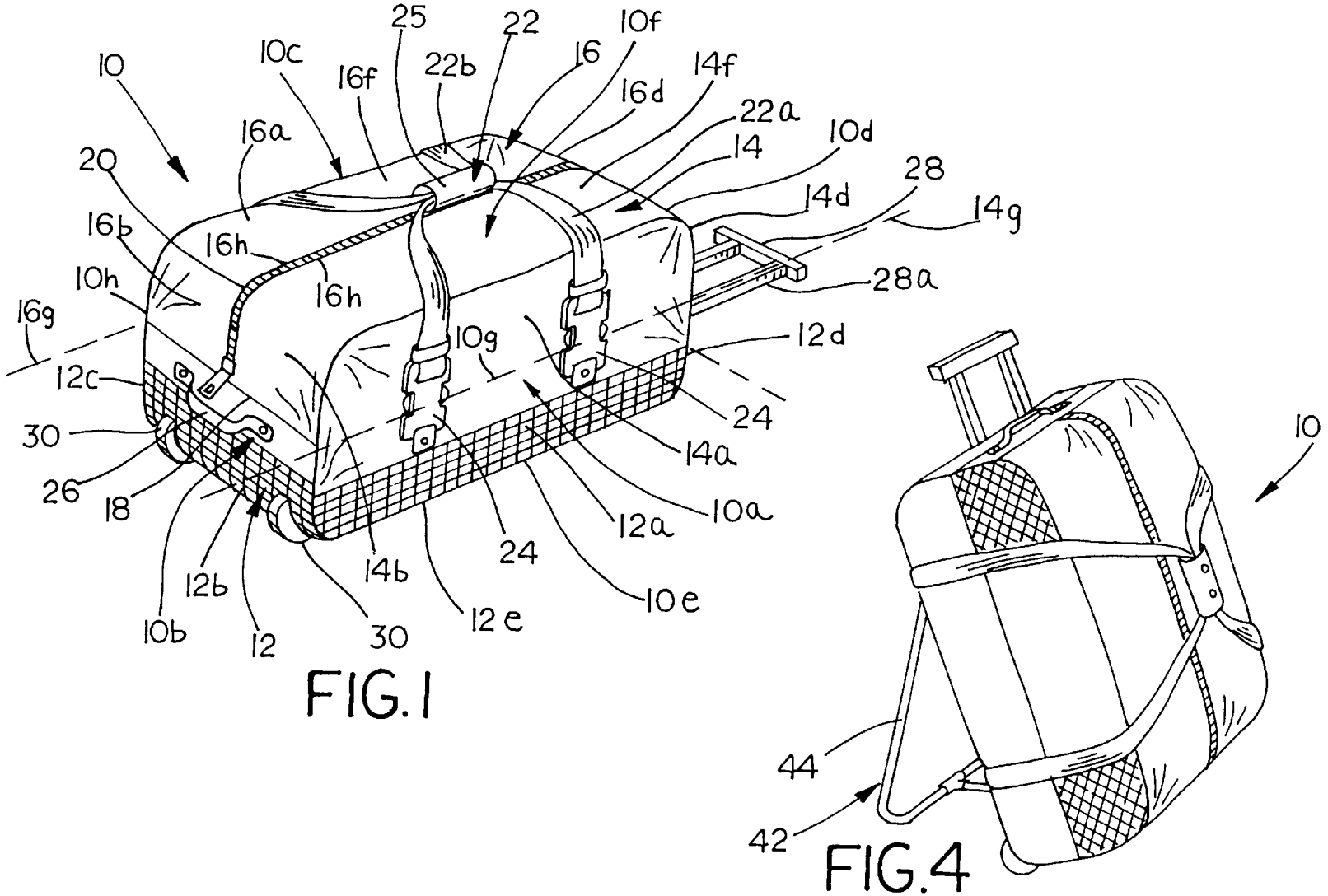
FIG. 1 is a perspective view illustrating a soft-sided carrying case assembled in accordance with the teachings of a first preferred embodiment of the invention.
FIG. 4 is a perspective view of the device of FIGS. 1–3 but illustrating an optional leg assembly.
Figure 2:
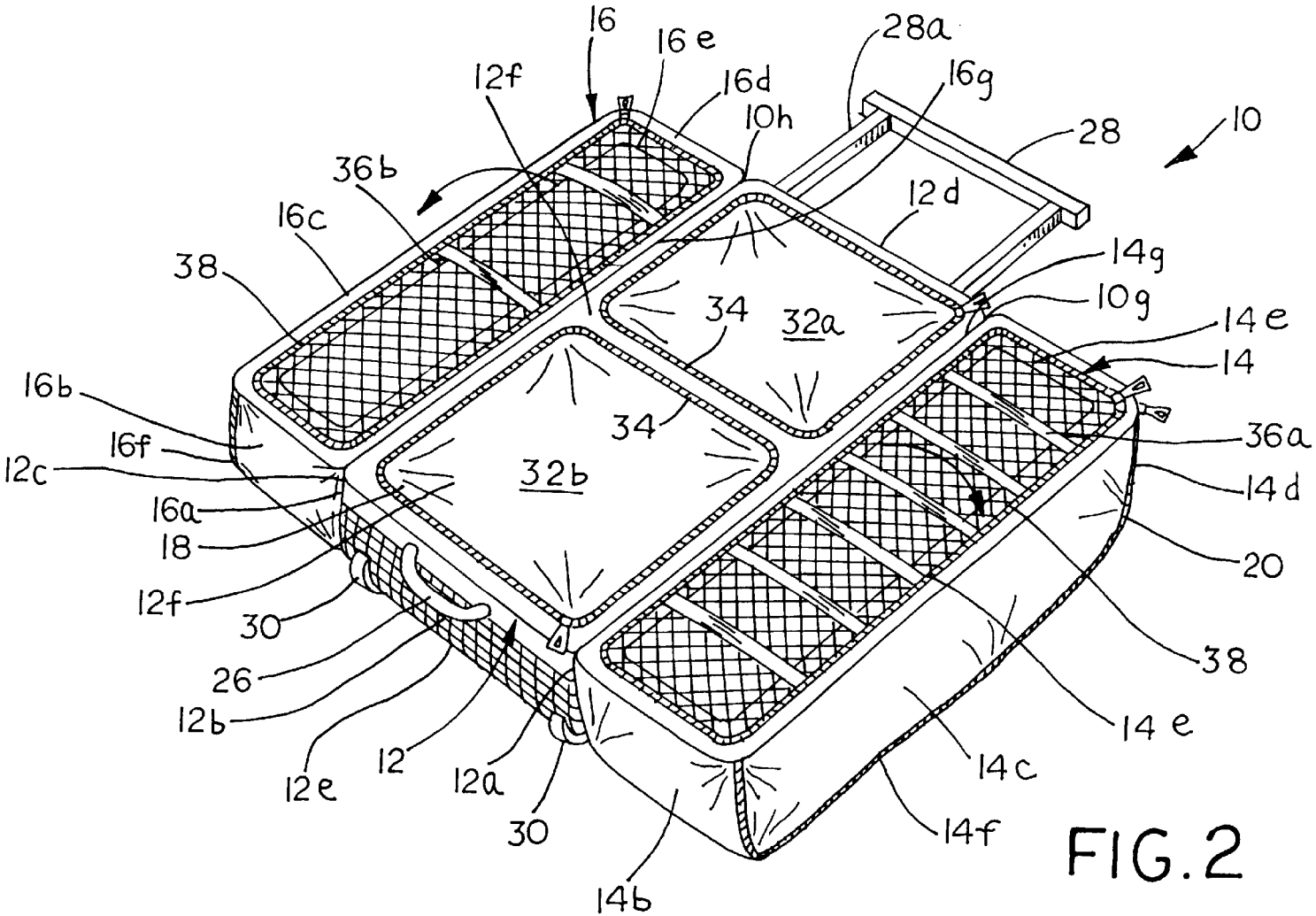
FIG. 2 is a perspective view of the soft-sided carrying case of claim 1 shown with the upper compartments opened to their unfolded positions.
Figure 3:
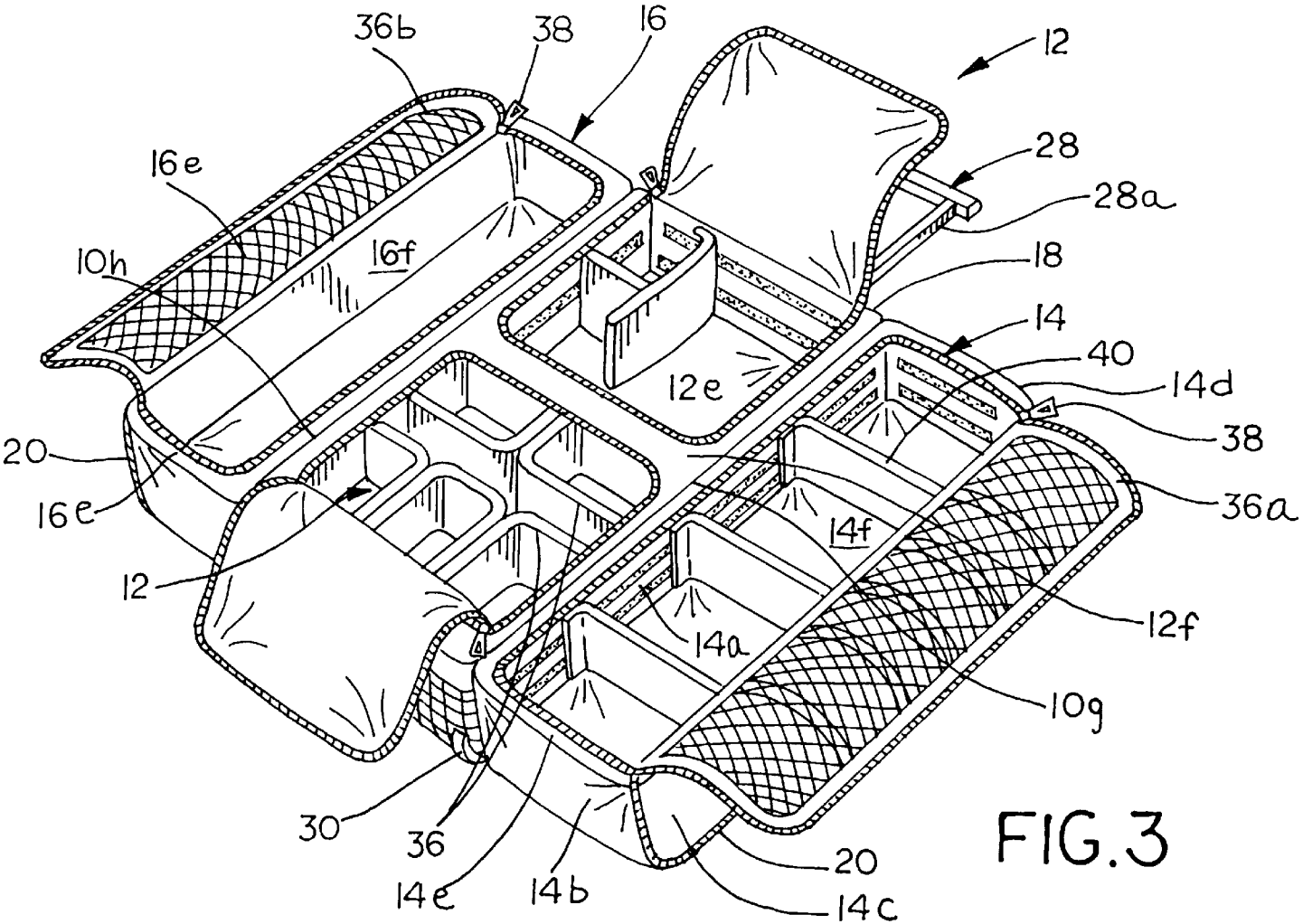
FIG. 3 is a perspective view similar to FIG. 2 but illustrating the flaps to the various compartments opened.

Referring now to FIGS. 1–3 of the drawings, a soft-sided carrying case assembled in accordance with the teachings of the present invention is generally referred to by the reference numeral 10. The soft-sided carrying case generally includes four sidewalls 10*a*, 10*b*, 10*c*, and 10*d*, a bottom wall 10*e* and a top wall 10*f* (FIG. 1). The case 10 further includes a lower compartment 12 and a pair of upper compartments 14 and 16. The lower compartment 12 includes a plurality of sidewalls 12*a*, 12*b* 12*c*, and 12*d*. The lower compartment 12 also includes a bottom wall 12*e* and a top wall 12*f* (visible in FIGS. 2 and 3). The first upper compartment 14 includes four sidewalls 14*a*, 14*b*, 14*c* (obscured in FIG. 1 but visible in FIGS. 2 and 3), and 14*d*. The first upper compartment 14 also includes a bottom wall 14*e* and a top wall 14*f* (the bottom wall 14*e* being visible in FIGS. 2 and 3). The second upper compartment 16 includes sidewalls 16*a*, 16*b*, 16*c* (visible in FIG. 3), and 16*d*. The second upper compartment also includes a bottom wall 16*e* and a top wall 16*f* (visible in FIG. 2). The first and second upper compartments 14, 16 are separated from the lower compartment 12 by a boundary or interface 18.

As will be outlined in greater detail below, the first upper compartment 14 is pivotable about a first hinge line 14*g* between the closed or folded position of FIG. 1 and the open or unfolded positions of FIGS. 2 and 3. Similarly, the second upper compartment 16 is pivotable about a hinge line 16*g* between the closed or folded position of FIG. 1 and the open or unfolded positions of FIGS. 2 and 3. It will be noted that the hinge lines 14*g* and 16*g* are generally adjacent to the interface 18 (i.e., the hinge lines 14*g* and 16*g* may lie in the same plane as the interface 18).

In the embodiment of FIGS. 1 through 3, it will be noted that the sidewall 14*a* of the first upper compartment 14 is generally contiguous with the sidewall 12*a* of the lower compartment (i.e., the sidewall 14*a* of the first upper compartment 14 is an extension of the sidewall 12*a* of the lower compartment). Similarly, the sidewall 16*a* of the second upper compartment 16 is contiguous with or is an extension of the sidewall 12*c* of the lower compartment 12.

The soft-sided carrying case 10 preferably includes a zipper 20 which engages each of the first and second upper compartments 14, 16 in order to secure each of the first and second upper compartments 14, 16 in their respective closed positions, such as is shown in FIG. 1. Upon release of the zipper 20, the first and second upper compartments 14, 16 may be pivoted about their respective hinge lines 14*g*, 16*g* to their respective unfolded positions as shown in FIGS. 2 and 3. The zipper 20 may be disposed along a longitudinal edge 14*h*, 16*h* (FIG. 1), of the first and second upper compartments 14, 16.

Instead of the zipper 20, it will be appreciated that alternate closure mechanisms may be provided in order to secure the first and second upper compartments 14, 16 in there respective folded positions. At least some of these possible alternate mechanisms are discussed below with respect to other forms of preferred embodiments. It will be understood that the closure mechanisms of the various embodiments may be readily substituted for each other as would be apparent to those of skill in the art.

Referring to FIG. 1, the soft-sided carrying case 10 will preferably include a handle 22, which in the preferred embodiment shown will include a pair of straps 22*a*, 22*b*, which straps 22*a* and/or 22*b* may be removably attached to the soft-sided carrying case 10 by a releaseable mechanism such as one or more buckles 24, such as commercially available Litelock® buckles. Alternatively, the straps 22*a* and 22*b* may be permanently affixed to the soft-sided case 10, such as by sewing, etc. The straps 22*a* and 22*b* will preferably be joinable to form the handle 22 using a section 25 of flexible material which is joinable using hook and loop closures or similar material as is known in the art. Additional handles 26, 28 may also be provided as desired, with the number of additional handles being within the choice of the designer. At least one of the handles (i.e., the handle 28) may be extendable, and when used in conjunction with a plurality of wheels 30 will enable the soft-sided carrying case 10 to be wheeled in a fashion similar to a luggage cart. The handle 28 may be made of commercially available materials, and further will preferably have a telescoping handle 28*a* enabling the entire handle 28 to be stowed in a zipper pocket in the bottom wall 10*e* of the carrying case 10. The wheels 30 are preferably commercially available in-line skate style wheels using sealed ball bearings. Other commercially available wheels may also be used.

Referring now to FIGS. 2 and 3, the lower compartment 12 preferably includes one or more panels or flaps 32*a*, 32*b* in the top wall 12*f* of the lower compartment 12. As shown, the flaps 32*a*, 32*b* each include a zipper 34, which enable the flaps 32*a*, 32*b* to be opened as shown in FIG. 3 to provide access to the lower compartment 12. It will be appreciated that one or more interior dividers 36 may be provided as desired inside the lower compartment 12.

Each of the bottom walls 14*f*, 16*f* of the first and second upper compartments 14, 16, respectively, will preferably include a panel or flap 36*a*, 36*b*, respectively. A zipper 38 maybe provided for each of the flaps 36*a*, 36*b*, thus enabling the flaps 36*a*, 36*b* to be secured in the closed position shown in FIG. 2 or opened to provide access to the first and second upper compartments 14, 16, as is shown in FIG. 3. One or more interior dividers 40 may be provided in either of the upper compartments 14, 16.

It will be appreciated that the soft-sided carrying case 10 may include additional compartments, such as side compartments or pockets (not shown) and/or end compartments or pockets (not shown), all of which are commonly used in the art. The soft-sided carrying case 10 may also include one or more mesh pockets of known construction.

The zippers used herein are preferably heavy-duty zippers, which zippers preferably have been taped as is known in the art. Further, the soft-sided case 10 may constructed of any one of a variety of commercially available fabrics and/or materials, all of which may be chosen based on design considerations for the specific application and all of which would be known to those of skill in the art. Rip-stop materials, which are readily available, may also be used.

In operation, the soft-sided carrying case 10 would normally be used and/or transported in the configuration of FIG. 1 with the first and second upper compartments 14, 16 in their respective closed or folded positions, generally overlying the lower compartment 12. The zipper 20 is shown securing the upper compartments 14, 16 in the folded positions. Using the section 25 the straps 22*a* and 22*b* may be joined together to form the handle 22. It will be understood that the soft-sided carrying case 10 may be readily assembled using known methods of manufacturing.

When it is desired to access the lower compartment and/or the first and second upper compartments 14, 16, the zipper 20 (or other closing mechanism) should be disengaged, as should the section 25 holding the straps 22*a* and 22*b* together. Either or both of the upper compartments 14, 16 may be pivoted about their respective hinge lines 14*g*, 16*g* to the unfolded positions shown in FIGS. 2 and 3. Access to the upper compartments 14, 16 may be gained by disengaging the zippers 38 (or other closing mechanism), thus enabling the flaps 36*a* and 36*b* to be opened. Access to the lower compartment 12 is gained by disengaging the zippers 34 (or other closing mechanism) thus enabling the flaps 32*a* and/or 32*b* to be opened.

In the embodiment of FIGS. 1–3 the hinge line 14*g* may be defined solely by a flexible portion 10*g* of the sidewall 10*a*, while the hinge line 16*g* may be formed solely by a flexible portion 10*h* of the sidewall 10*c*, with no actual physical hinge structure being employed. It will be appreciated that the flexible portions 10*g* and 10*h* are disposed substantially in line with the interface 18 between the lower compartment 12 and the first and second upper compartments 14 and 16. Alternatively, the hinge lines 14*g* and 16*g* may be defined by actual physical hinge structures as shown and described below with respect to the other embodiments.

Each of the upper compartments 14, 16 may also include an additional exterior flap or zipper (not shown) in order to provide access to the first and second upper compartments 14, 16 without pivoting the upper compartments 14, 16 to their unfolded positions. Further, additional side pockets may be provided on the soft-sided carrying case 10 in a manner that is known to those skilled in the art. Further, it will be understood that the bottom wall 10*e* may be constructed of a relatively stiff material or a rigid material for greater durability. Such relatively stiff and/or rigid materials are known to those skilled in the art and are readily available.

Compression straps (not shown) may be provided in order to secure the upper compartments in their closed positions.

Also, it will further be appreciated that zippers shown above may be replaced with any number of known closing or securing mechanisms, such as, by way of example and not limitation, straps, buckles, snaps, buttons, and hook and loop closure materials.

Figure 3A:
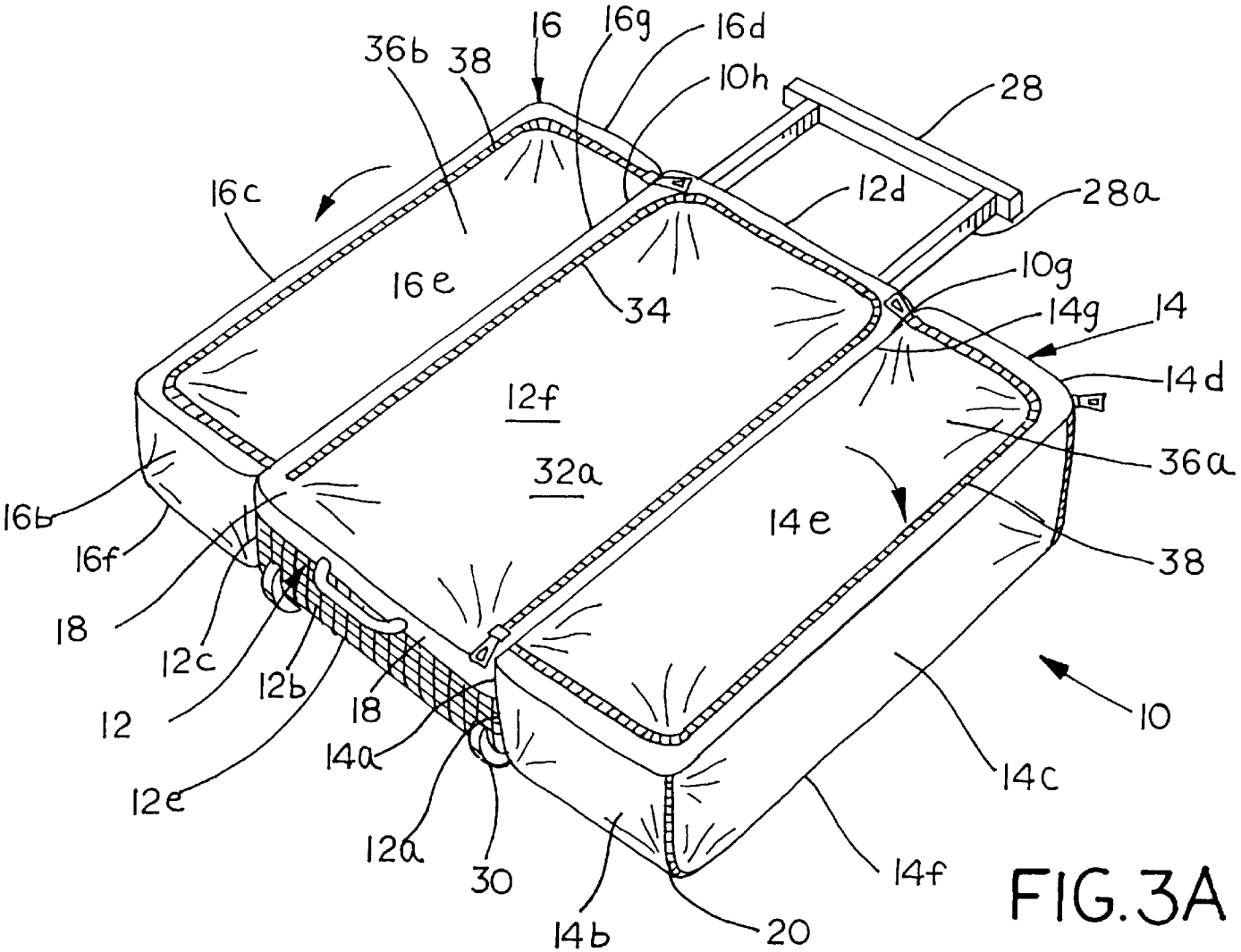
FIG. 3A is a perspective view similar to FIG. 2 but showing an alternate form for the panels or flaps.

Referring now to FIG. 3A, an alternate form for the soft-sided carrying case is shown, also designated as 10 for ease of reference. The soft-sided carrying case 10 illustrated therein is substantially similar to the soft-sided case 10 discussed above, with each of the like elements retaining the same reference characters. As shown in FIG. 3A, the lower compartment 12 includes only a single flap 32*a* with a zipper 34. It will be appreciated that the lower compartment 12 may include additional access flaps (not shown), with the actual number and configuration of the access flaps being governed by design considerations.

Figure 5:
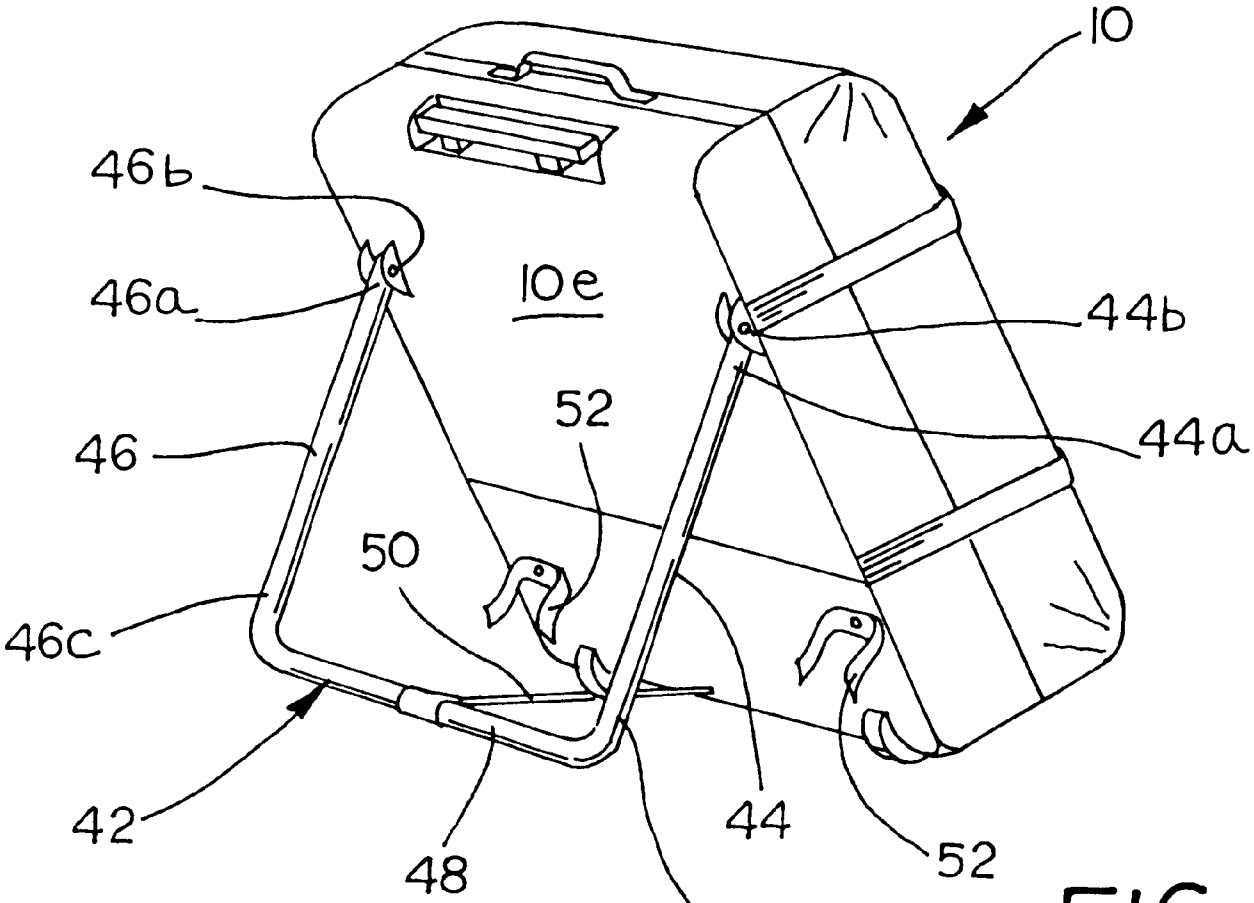
FIG. 5 is a view of the device of FIG. 4 but taken from a different perspective.

Referring now to FIGS. 4 and 5, any of the embodiments of the soft-sided carrying case disclosed herein may optionally be equipped with a retractable stand 42. In the embodiment shown in FIGS. 4 and 5, the soft-sided carrying case 10 is shown equipped with the optional stand 42. As shown in FIG. 5, the stand 42 may include a pair of legs 44 and 46. The leg 44 includes an upper end 44*a* attached to the soft-sided carrying case 10 by a pivot 44*b*, while the leg 46 includes an upper end 46*a* attached to the soft-sided case 10 by a pivot 46*b*. A cross bar 48 is disposed to connect a lower end 44*c* of the leg 44 to a lower end 46*c* of the leg 46. A strap 50 engages the cross bar 48 and the case 10 in order to limit the extension of the stand 42 away from the case 10. A pair of hook and loop retaining straps 52 are provided in order to retain the stand 42 in a retracted position against the bottom wall 10*e* of the carrying case 10 when the stand 42 is not in use.

Figure 6:
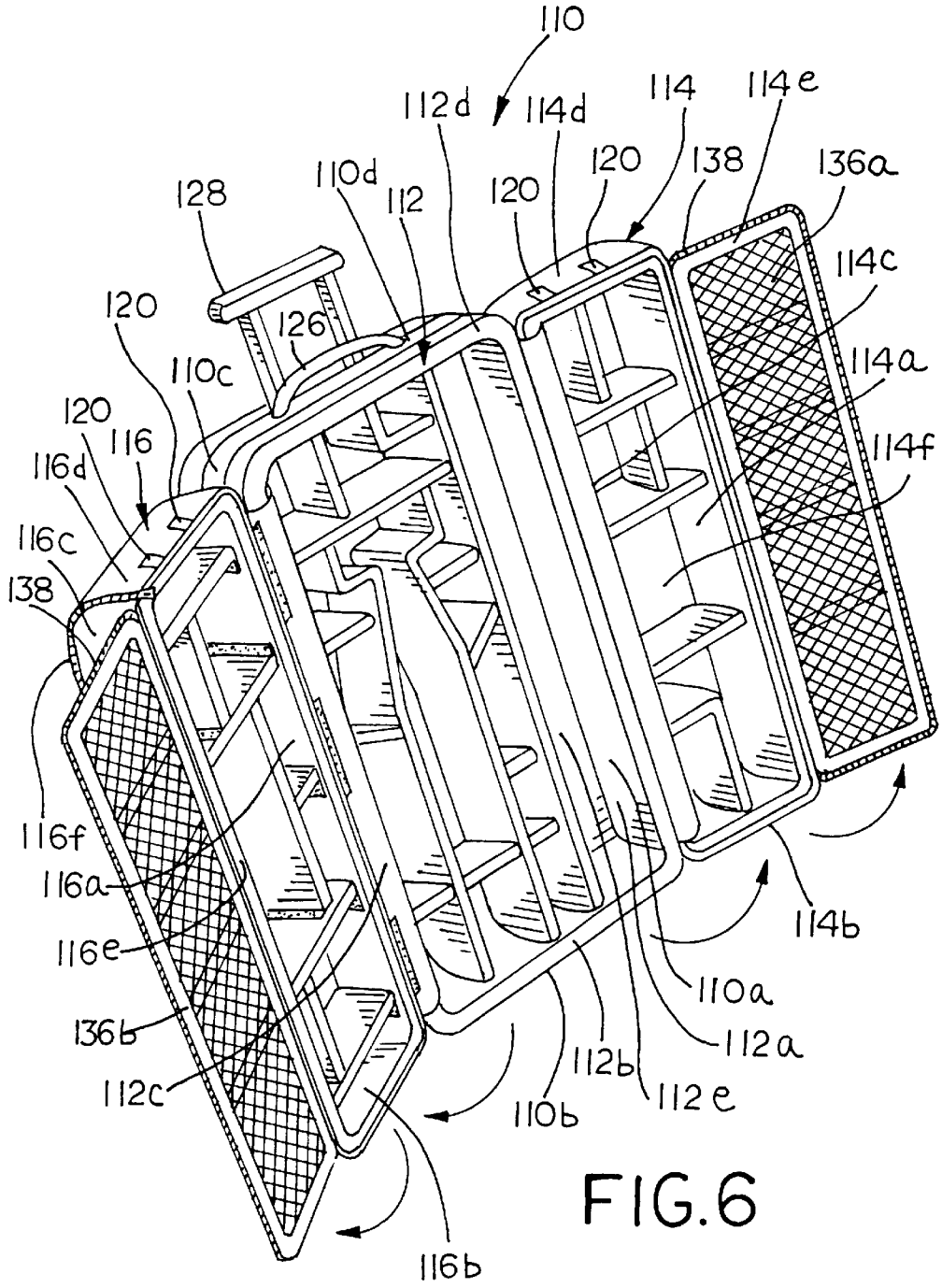
FIG. 6 is a perspective view of a soft-sided carrying case assembled in accordance with the teachings of a second preferred embodiment of the invention.

Referring now to FIG. 6, a soft-sided carrying case assembled in accordance with the teachings of a second preferred embodiment of the invention is generally referred to by the reference numeral 10. For ease of reference, all elements that are the same or similar to the elements described above with respect to the first embodiment will retain the same reference numerals, but which have been increased by 100. The soft-sided carrying case 110 generally includes four sidewalls 110*a*, 110*b*, 110*c*, and 110*d*, a bottom wall 110*e*, which may be rigid, and a top wall. The case 110 further includes a lower compartment 112 and a pair of upper compartments 114 and 116. The lower compartment 112 includes a plurality of sidewalls 112*a*, 112*b*, 112*c*, and 112*d*. The lower compartment 112 also includes a bottom wall 112*e*. It will be noted that no top wall is shown for the compartment 112, with the upper extent of the compartment 112 being defined upon the closing of the compartments 114 and 116. Alternatively, a top wall (not shown) or a mesh panel (not shown) may be provided.

The first upper compartment 114 includes encircling sidewalls 114*a*, a bottom wall 114*e* and a top wall 114*f*, which may be defined by a flap or a mesh panel. The second upper compartment 116 includes sidewalls 116*a*, and includes a bottom wall 16*e* and a top wall 16*f*, which may be defined by a flap or a mesh panel. The first and second upper compartments 114, 116 are pivotally joined to the lower compartment 112 by one or more hinges 14*g*, 16*g* which lie along an interface 118 between the upper compartments 114, 116 and the lower compartment 112, and which permit pivotal movement of the upper compartments between the folded positions (i.e., with the upper compartments 114, 116 disposed above the lower compartment 112 in the manner described above with respect to the first embodiment) and the open or unfolded positions shown in FIG. 6. Preferably, the embodiment of FIG. 6 will include a seal 119 disposed at the interface 118 of the lower compartment 112 and the upper compartments 114, 116. Flaps 136*a*, 136*b* are provided for the compartments 114, 116, respectively, each of the flaps 136*a* and 136*b* being closeable with a zipper 138 or similar closing mechanism. The carrying case 110 preferably includes one or more closing buckles 120. The soft-sided carrying case 10 will also preferably include one or more handles 126, 128, with the handles 128 being extendable. A plurality of wheels (not shown) may also be provided.

Figures 7, 8:
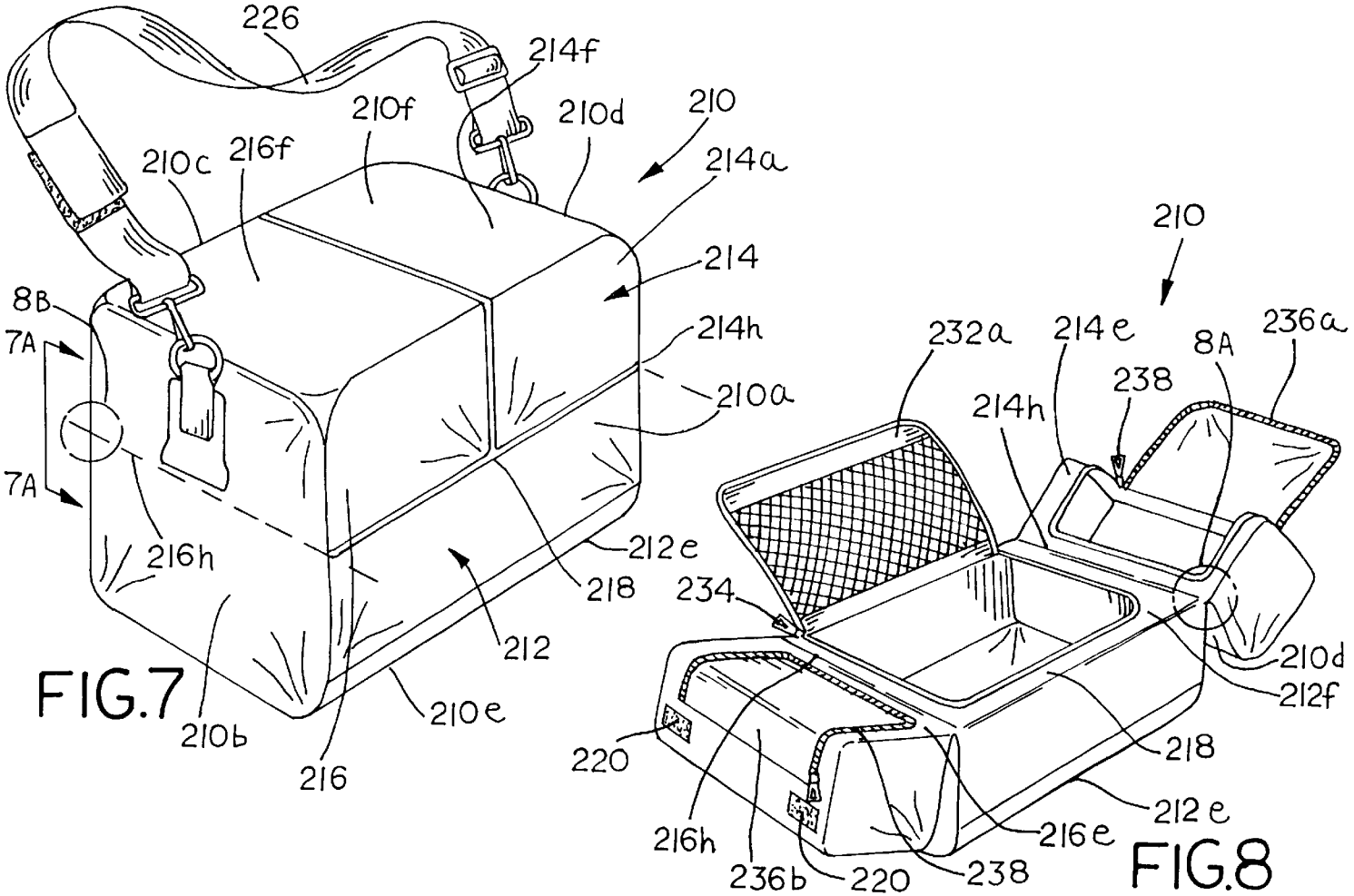
FIG. 7 is a perspective view of a soft-sided carrying case assembled in accordance with the teachings of a third preferred embodiment of the invention.
FIG. 8 is a perspective view of the device of FIG. 7 but illustrating the upper compartments in the unfolded positions.

Referring now to FIGS. 7 and 8, a soft-sided carrying case assembled in accordance with the teachings of a third preferred embodiment of the invention is generally referred to by the reference numeral 210. For ease of reference, all elements that are the same or similar to the elements described above with respect to the first embodiment will retain the same reference numerals, but which have been increased by 200. The soft-sided carrying case 210 generally includes four sidewalls 210*a*, 210*b*, 210*c*, and 210*d*, a bottom wall 210*e* and a top wall 210*f*. The case 210 further includes a lower compartment 212 and a pair of upper compartments 214 and 216. The lower compartment 212 includes a plurality of sidewalls 212*a*, 212*b*, 212*c*, and 212*d*. The lower compartment 212 also includes a bottom wall 212*e* and a top wall 212*f* (FIG. 8).

The first upper compartment 214 includes a plurality of sidewalls 214*a*, a bottom wall 214*e* (FIG. 8) and a top wall

214*f* (FIG. 7). The second upper compartment 216 includes a plurality of sidewalls 216A, and includes a bottom wall 216*e* (FIG. 8) and a top wall 216*f* (FIG. 7). The first and second upper compartments 214, 216 are pivotally joined to the lower compartment 212 by a flexible fabric hinge 214*h*, 216*h*, respectively, defined in the sidewalls 210*b* and 210*d* of the soft-sided carrying case 210, and lying generally along an interface 218 between the upper compartments 214, 216 and the lower compartment 212. The fabric hinges 214*h*, 216*h* permit pivotal movement of the upper compartments 214, 216 between the folded positions (i.e., with the upper compartments 214, 216 disposed above the lower compartment 212 in the manner described above with respect to the first embodiment) and the open or unfolded positions shown in FIG. 8.

An access flap 232*a* having a zipper 234 is provided in the top wall 212*f* of the lower compartment 212. Flaps 236*a*, 236*b* are provided for the compartments 214, 216, respectively, each of the flaps 236*a* and 236*b* being closeable with a zipper 238 or similar closing mechanism. The carrying case 210 preferably includes one or more sections of hook and loop closure mechanisms 220. Alternatively, straps or other mechanisms may be used. The soft-sided carrying case 210 will also preferably include a shoulder strap 226 (FIG. 7), or a handle (not shown).

Figure 7A:
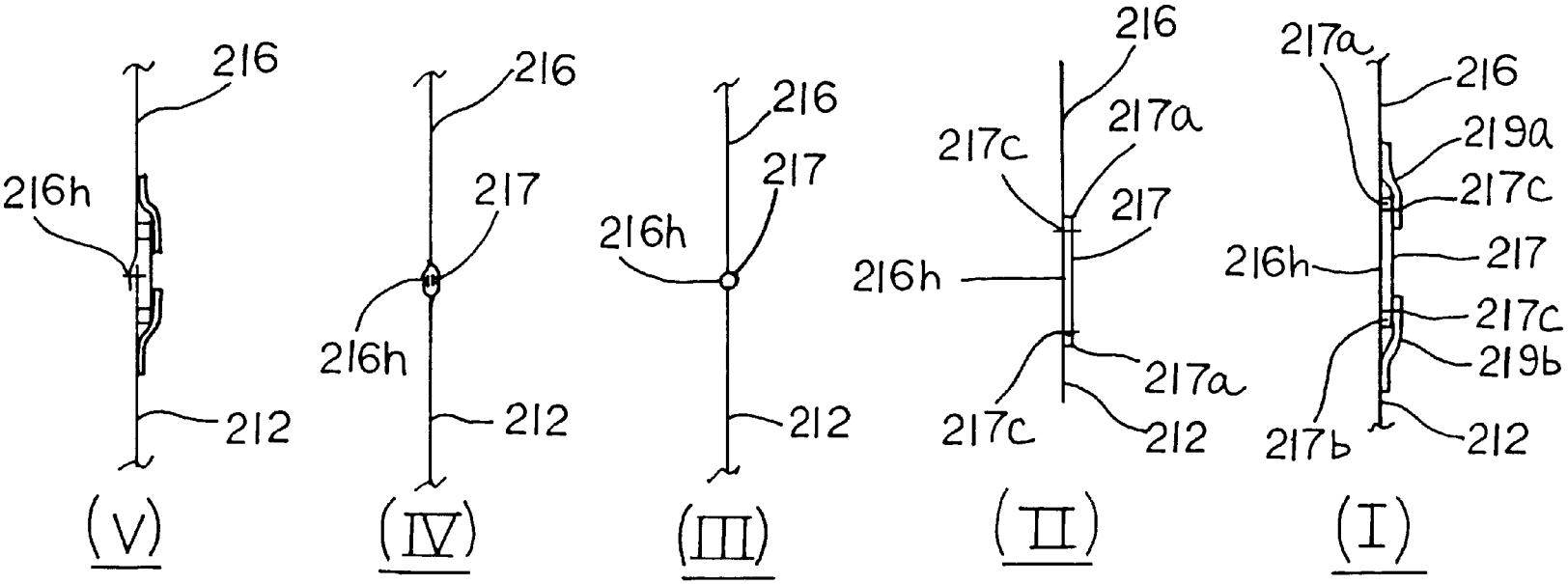
FIGS. 7A(*i*) through 7A(*v*) are enlarged fragmentary cross-sectional views of a number of alternative arrangements in the area of the hinge line, which alternative arrangements are equally applicable to any of the embodiments disclosed herein.

Referring now to FIGS. 7A(*i*) through 7A(*v*), alternative details are shown for the construction of the soft-sided carrying case 210 in the region of the hinge line 216*h*. It will be understood that the details shown therein are equally applicable to the hinge line 214*h*, and also are equally applicable to any of the other embodiments described herein. However, for the sake of brevity, the details will be discussed only with respect to the embodiment of FIGS. 7 and 8. For ease of reference, to the extent possible similar elements will retain like reference numerals through each of FIGS. 7A(*i*) through 7A(*v*).

As shown in FIG. 7A(*i*), a fabric strap 217 having an upper edge 217*a* and a lower edge 217*b* is secured to the soft-sided carrying case 210. The upper edge 217*a* is secured to the upper compartment 216 by a line of stitching 217*c*, while the lower edge 217*b* is secured to the lower compartment 21 by a line of stitching 217*d*. Two additional straps 219*a* and 219*b* are provided, with the strap 219*a* being stitched to the upper edge 217*a* as well as to the upper compartment 216, and with the strap 219*b* being stitched to the lower edge 217*b* as well as to the lower compartment 212. Preferably, the lines of stitching may be bartack stitching for greater durability in high stress areas.

As shown in FIG. 7A(*ii*), a single fabric strap 217 may be employed, having an upper edge 217*a* stitched at 217*c* to the upper compartment 216, and further having a lower edge 217*b* stitched at 217*d* to the lower compartment 212.

As shown in FIG. 7A(*iii*), a line of piping 217 may be employed along the hinge line 216*h*.

As shown in FIG. 7A(*iv*), a zipper 217 may be disposed along the hinge line 216*h*. The zipper 217 is preferably a #8 or #10 heavy-duty, taped, clear coil zipper.

FIG. 7A(*v*) is similar in all respects to FIG. 7A(*i*), except for the addition of a line of stitching 217 at the hinge line 216*h* which may be required when the upper compartment 216 and the lower compartment 212 are manufactured of dissimilar materials or dissimilar colors.

Figure 8A:
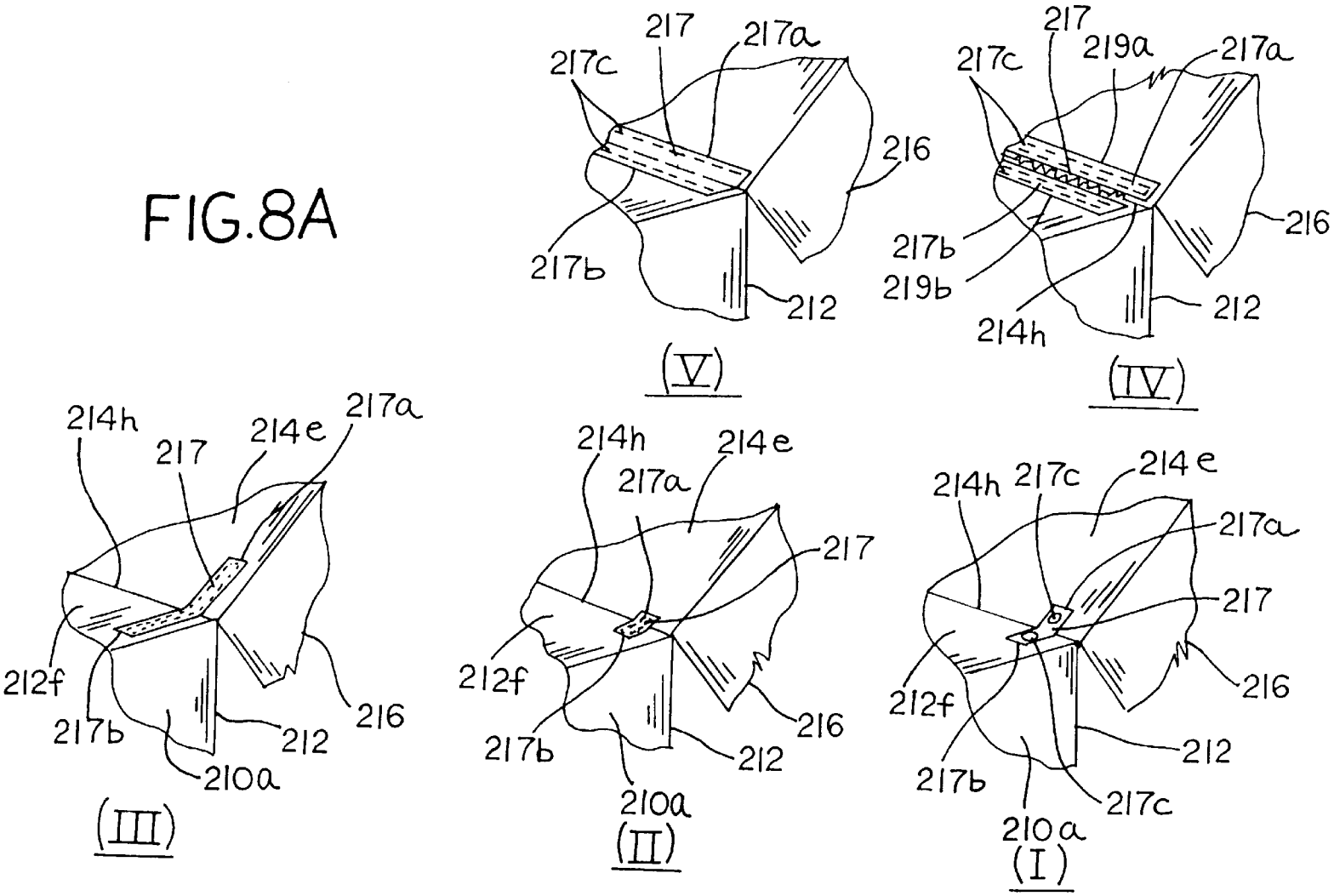
FIGS. 8A(*i*) through 8A(*v*) are enlarged fragmentary views in perspective taken about the circumscribed portion of FIG. 8 and illustrating a number of alternative details in the area surrounding the hinge, which details are equally applicable to any of the embodiments disclosed herein.

Referring now to FIGS. 8A(*i*) through 8A(*v*), further alternative details are shown for the construction of the soft-sided carrying case 210 in the region of the hinge line 216*h*. It will again be understood that the details shown therein are equally applicable to the hinge line 214*h*, and also are equally applicable to any of the other embodiments described herein. Again, for the sake of brevity, the details will be discussed only with respect to the embodiment of FIGS. 7 and 8. For ease of reference, to the extent possible similar elements will retain like reference numerals through each of FIGS. 7A(*i*) through 7A(*v*).

As shown in each of FIGS. 8A(*i*) through 8A(*v*), a fabric strap 217 having edges 217*a* and 217*b* is secured to each of the upper and lower compartments shown, 216 and 212, respectively. In each of the details shown, the straps are secured such that the straps 217 are only revealed upon opening of the upper compartment 216 to its unfolded position. In FIG. 8A(*i*), the strap 217 is secured by one or more fasteners 217*c*, such as a snap, a rivet, a threaded bolt, a button, or any other suitable fastener, either alone or in combination with stitching.

FIGS. 8A(*ii*) and 8A(*iii*) illustrate straps 217 having different overall dimensions secured by bartack stitching. FIGS. 8A(iv) and 8A(*v*) illustrate straps 217 secured in a manner similar to that shown in FIGS. 7A(*i*) and (*ii*), albeit with the details being applied to the inside of the hinge line 216*h* rather than to the outside of the case 210.

Figure 8B:
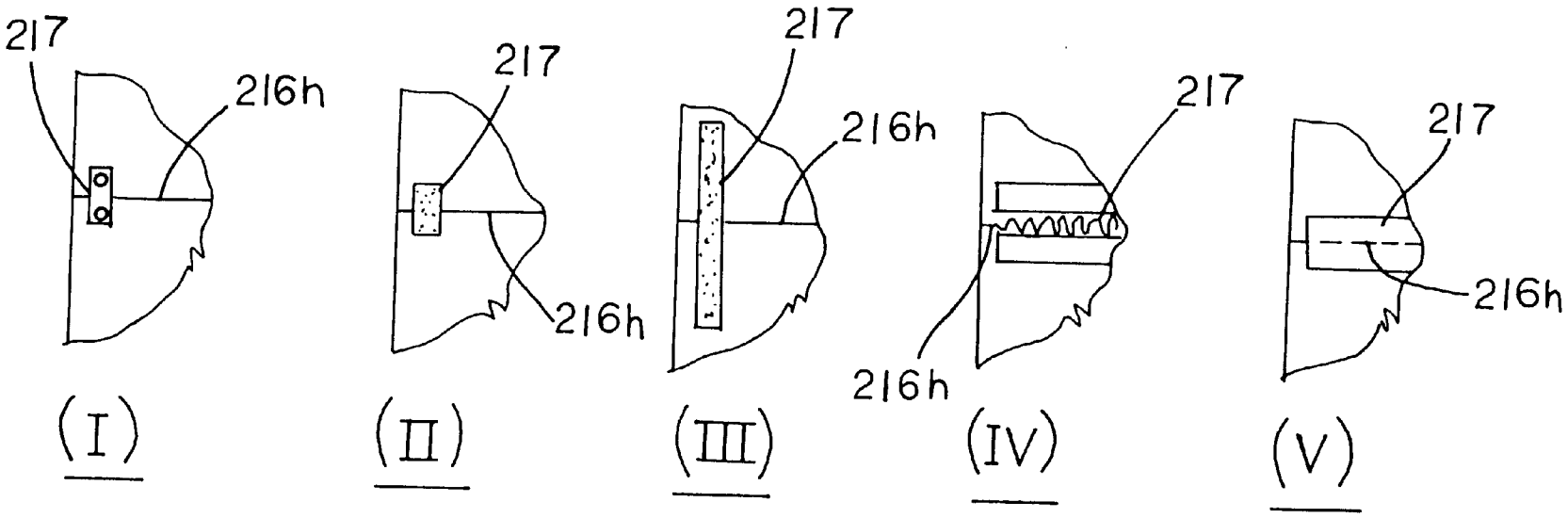
FIGS. 8B(*i*) through 8B(*v*) are enlarged fragmentary elevational views taken about the circumscribed portion of FIG. 7 and illustrating alternative details similar to those shown in FIGS. 8A(*i*) through 8A(*v*), but illustrating those details applied to the outside surface of the soft-sided carrying case.

Referring now to FIGS. 8B(*i*) through 8B(*v*), illustrated therein are arrangements similar to FIGS. 8A(*i*) through (*v*), but with each of the respe4ctive arrangements being shown secured to the outside of the soft-sided carrying case 210.

Figures 9, 10:
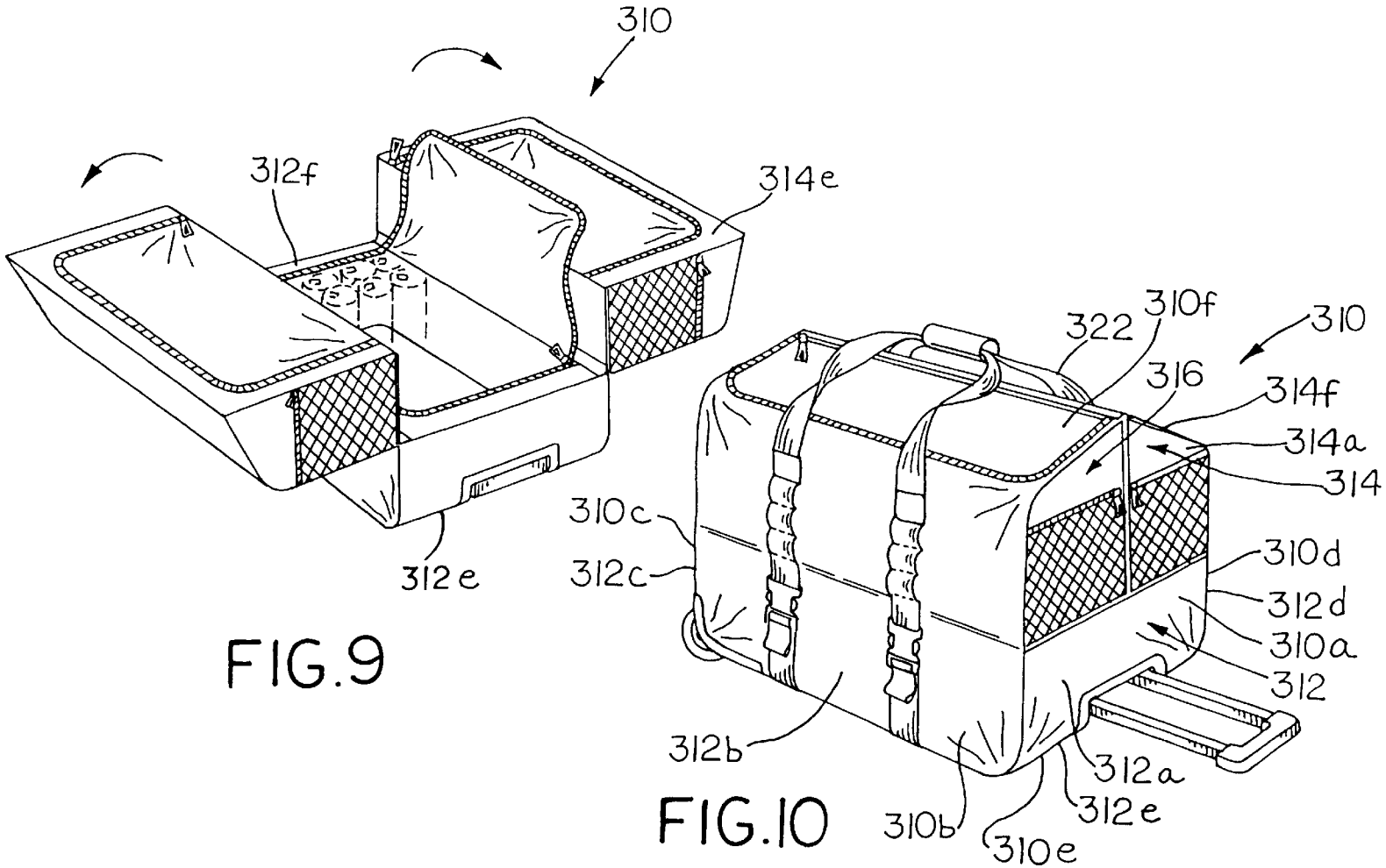
FIG. 9 is a perspective view of a soft-sided carrying case assembled in accordance with the teachings of a fourth preferred embodiment of the invention.
FIG. 10 is a perspective view of the device of FIG. 9 but illustrating the upper compartments in the unfolded positions.

Referring now to FIGS. 9 and 10, a soft-sided carrying case assembled in accordance with the teachings of a fourth preferred embodiment of the invention is generally referred to by the reference numeral 310. For ease of reference, all elements that are the same or similar to the elements described above with respect to the first embodiment will retain the same reference numerals, but which have been increased by 300. The soft-sided carrying case 310 generally includes four sidewalls 310*a*, 310*b*, 310*c*, and 310*d*, a bottom wall 310*e* and a top wall 310*f*. The case 310 further includes a lower compartment 312 and a pair of upper compartments 314 and 316. The lower compartment 312 includes a plurality of sidewalls 312*a*, 312*b*, 312*c*, and 312*d*. The lower compartment 312 also includes a bottom wall 312*e* and a top wall 312*f* (FIG. 10).

The first upper compartment 314 includes a plurality of sidewalls 314*a*, a bottom wall 314*e* (FIG. 10) and a top wall 314*f*. The second upper compartment 316 includes a plurality of sidewalls 316*a*, and includes a bottom wall 316*e* and a top wall 316*f*. The first and second upper compartments 314, 316 are pivotally joined to the lower compartment 312 along a pair of hinge lines 314*g*, 316*g*, respectively, defined in the sidewalls 310*b* and 310*d* of the soft-sided carrying case 310 by a two lines of stitching 314*h*, 316*h*, respectively. The lines of stitching 314*h*, 316*h* are disposed lying generally along an interface 318 between the upper compartments 314, 316 and the lower compartment 312. Other suitable hinges may be employed. Thus, the upper compartments 314, 316 are shiftable between the folded positions (i.e., with the upper compartments 314, 316 disposed above the lower compartment 312 in the manner described above with respect to the first embodiment) and the open or unfolded positions shown in FIG. 10.

An access flap 332*a* having a zipper 334 is provided in the top wall 312*f* of the lower compartment 312. Flaps 336*a*, 336*b* are provided for the compartments 314, 316, respectively, each of the flaps 336*a* and 336*b* being closeable with a zipper 338 or similar closing mechanism. The carrying case 310 preferably includes one or more sections of hook and loop closure mechanisms 320. Alternatively, straps or other mechanisms may be used. The soft-sided carrying case 310 will also preferably include a suitable handle 322 and or an extendible handle 328.

Figure 11:
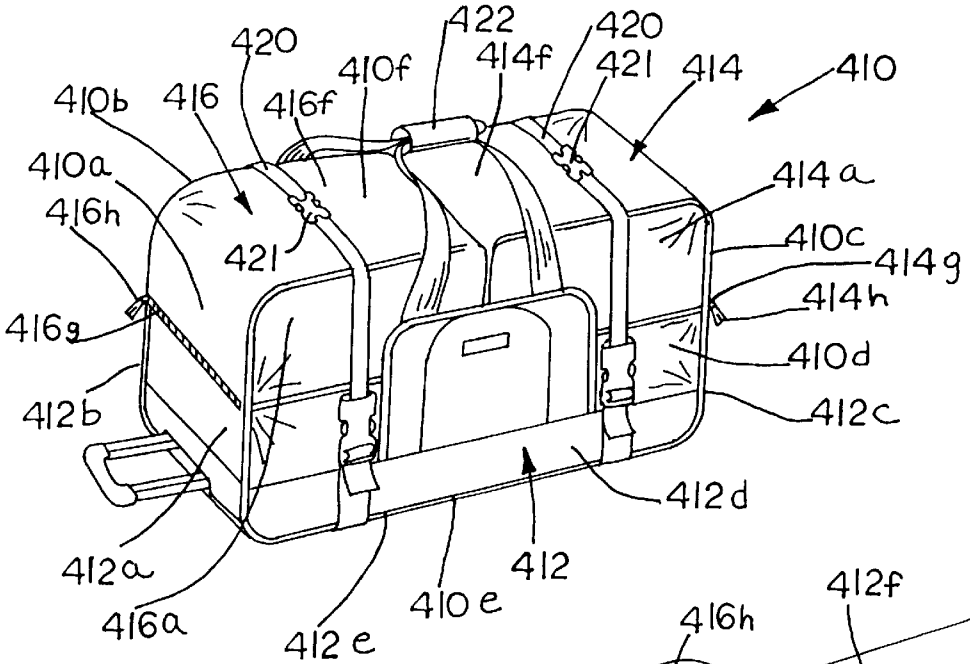
FIG. 11 is a perspective view of a soft-sided carrying case assembled in accordance with the teachings of a fifth preferred embodiment of the invention.
Figure 12:
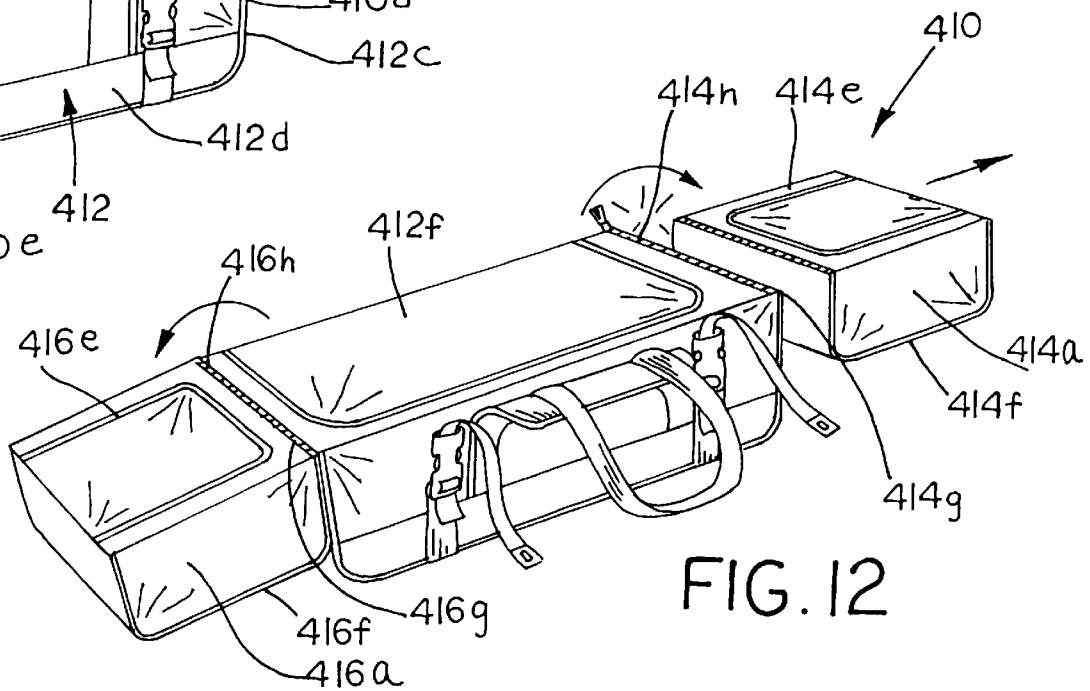
FIG. 12 is a perspective view of the device of FIG. 11 but illustrating the upper compartments in the unfolded positions.

Referring now to FIGS. 11 and 12, a soft-sided carrying case assembled in accordance with the teachings of a fifth preferred embodiment of the invention is generally referred to by the reference numeral 410. For ease of reference, all elements that are the same or similar to the elements described above with respect to the first embodiment will retain the same reference numerals, but which have been increased by 400. The soft-sided carrying case 410 generally includes four sidewalls 410*a*, 410*b*, 410*c*, and 410*d*, a bottom wall 410*e* and a top wall 410*f*. The case 410 further includes a lower compartment 412 and a pair of upper compartments 414 and 416. The lower compartment 412 includes a plurality of sidewalls 412*a*, 412*b*, 412*c*, and 412*d*. The lower compartment 412 also includes a bottom wall 412*e* and a top wall 412*f* (FIG. 12).

The first upper compartment 414 includes a plurality of sidewalls 414*a*, a bottom wall 414*e* (FIG. 12) and a top wall 414*f*. The second upper compartment 416 includes a plurality of sidewalls 416*a*, and includes a bottom wall 416*e* (FIG. 12) and a top wall 416*f*. The first and second upper compartments 414, 416 are pivotally joined to the lower compartment 412 along a pair of hinge lines 414*g*, 416*g*, respectively, defined in the sidewalls 410*a* and 410*c* of the soft-sided carrying case 410 by a releasable zippers 414*h*, 416*h*, respectively. The zippers 414*h*, 416*h* are disposed lying generally along an interface 418 between the upper compartments 414, 416 and the lower compartment 412. Other suitable releasable mechanisms may be employed. Thus, the upper compartments 414, 416 are shiftable between the folded positions (i.e., with the upper compartments 414, 416 disposed above the lower compartment 412 in the manner described above with respect to the first embodiment) and the open or unfolded positions shown in FIG. 12.

As with the above embodiments, suitable access flaps may be provided to provide access to the various compartments. Also, carrying case 410 preferably includes one or more closing straps 420, each of which may include one or more buckles 421 or other suitable releasable closing mechanisms, such as straps having hook and loop closures, snaps, buttons, etc. The soft-sided carrying case 410 will also preferably include a suitable handle, such as the handle 422.

Figure 13:
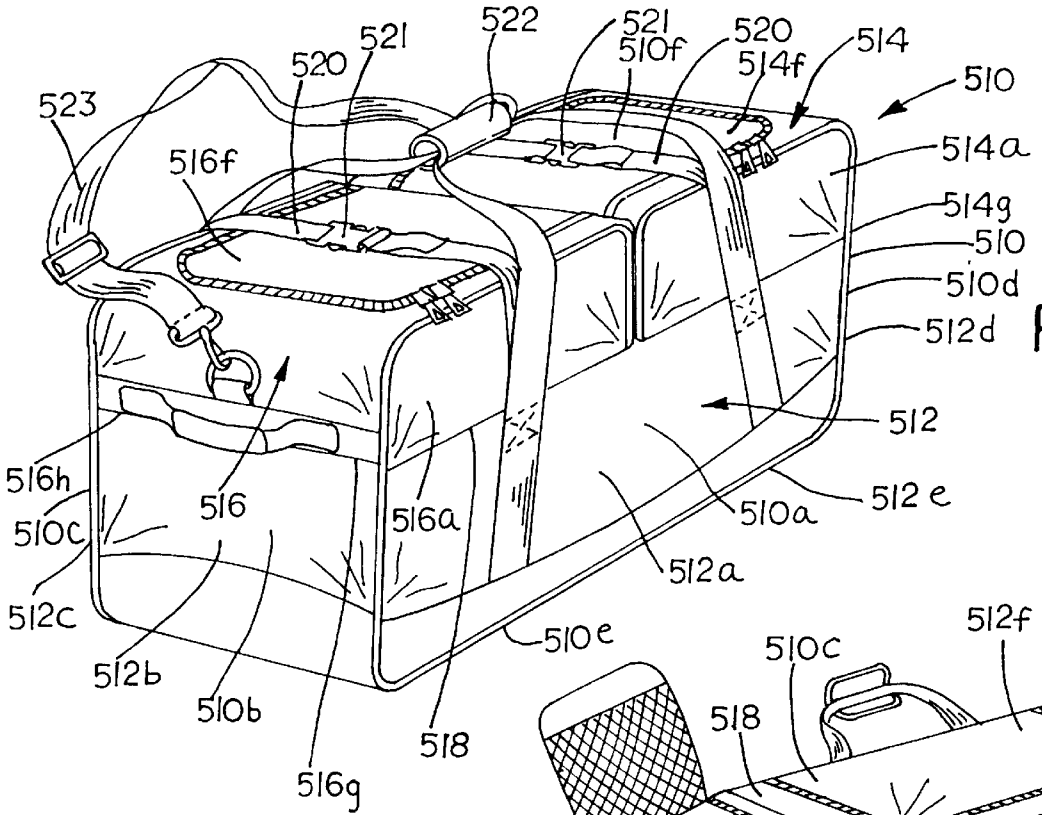
FIG. 13 is a perspective view of a soft-sided carrying case assembled in accordance with the teachings of a sixth preferred embodiment of the invention.
Figure 14:
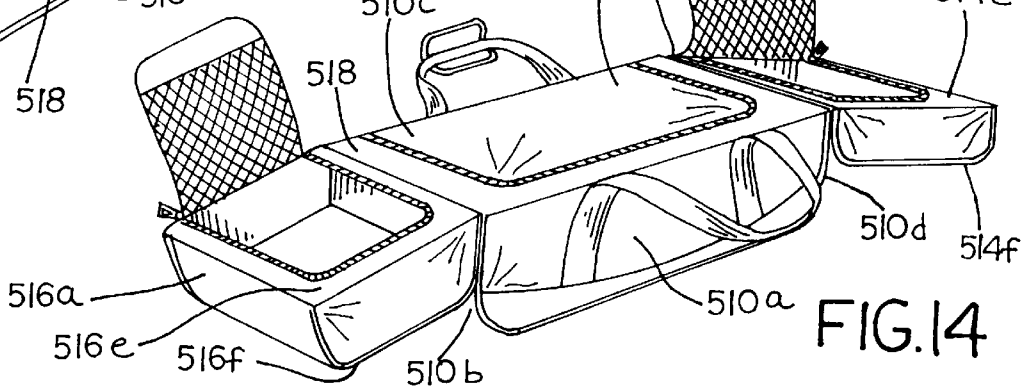
FIG. 14 is a perspective view of the device of FIG. 13 but illustrating the upper compartments in the unfolded positions.

Referring now to FIGS. 13 and 14, a soft-sided carrying case assembled in accordance with the teachings of a fifth preferred embodiment of the invention is generally referred to by the reference numeral 510. For ease of reference, all elements that are the same or similar to the elements described above with respect to the first embodiment will retain the same reference numerals, but which have been increased by 500. The soft-sided carrying case 510 generally includes four sidewalls 510*a*, 510*b*, 510*c*, and 510*d*, a bottom wall 510*e* and a top wall 510*f*. The case 510 further includes a lower compartment 512 and a pair of upper compartments 514 and 516. The lower compartment 512 includes a plurality of sidewalls 512*a*, 512*b*, 512*c*, and 512*d*. The lower compartment 512 also includes a bottom wall 512*e* and a top wall 512*f* (FIG. 14).

The first upper compartment 514 includes a plurality of sidewalls 514*a*, a bottom wall 514*e* (FIG. 14) and a top wall 514*f*. The second upper compartment 516 includes a plurality of sidewalls 516*a*, and includes a bottom wall 516*e* (FIG. 14) and a top wall 516*f*. The first and second upper compartments 514, 516 are pivotally joined to the lower compartment 512 along a pair of hinge lines 514*g*, 516*g*, respectively, defined in the sidewalls 510*b* and 510*d* of the soft-sided carrying case 510 by lines of stitching 514*h*, 516, respectively. The lines of stitching 514*h*, 516*h* are disposed lying generally along an interface 518 between the upper compartments 514, 516 and the lower compartment 512. Other suitable hinge mechanisms may be employed. Thus, the upper compartments 514, 516 are shiftable between the folded positions (i.e., with the upper compartments 514, 516 disposed above the lower compartment 512 in the manner described above with respect to the first embodiment) and the open or unfolded positions shown in FIG. 14.

As with the above embodiments, suitable internal and/or external access flaps may be provided to provide access to the various compartments. Also, carrying case 510 preferably includes one or more closing straps 520, each of which may include one or more buckles 521 or other suitable releasable closing mechanisms, such as straps having hook and loop closures, snaps, buttons, etc. The soft-sided carrying case 510 will also preferably include a suitable handle, such as the handle 522, and/or a shoulder strap 523.

Figure 16:
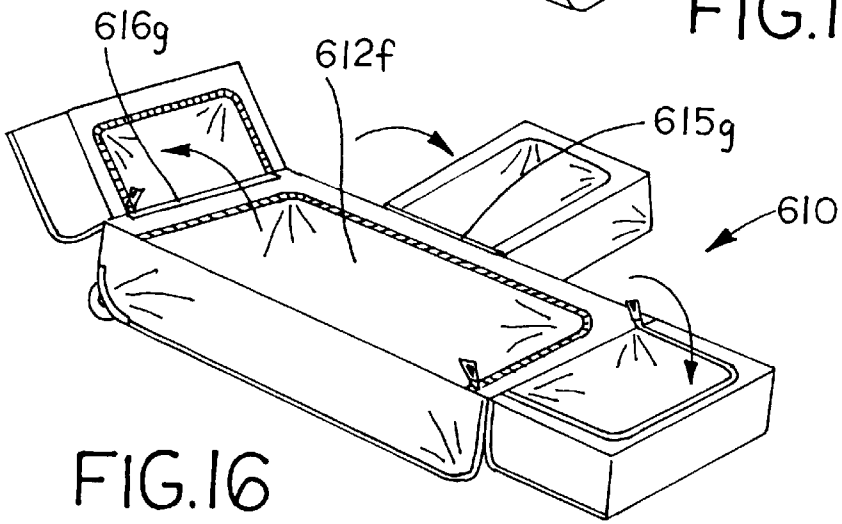
FIG. 16 is a perspective view of the device of FIG. 15 but illustrating all of the upper compartments in the unfolded positions.
Figure 15:
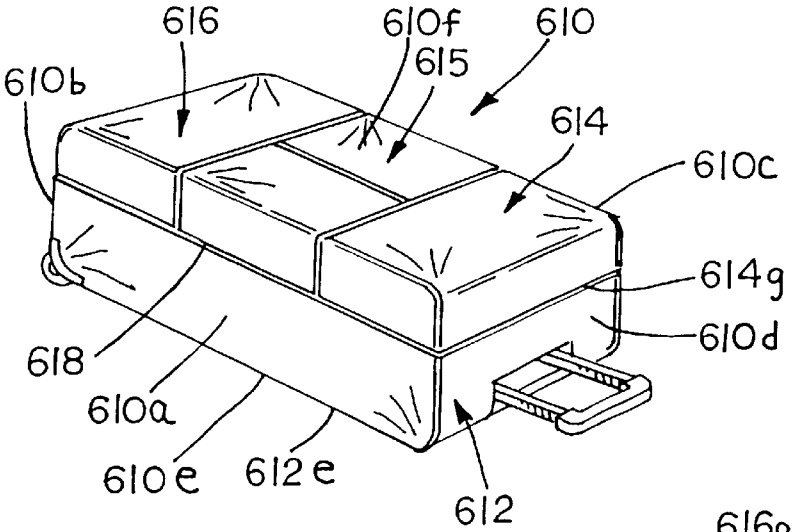
FIG. 15 is a perspective view of a soft-sided carrying case assembled in accordance with the teachings of a seventh preferred embodiment of the invention.
Figure 18:
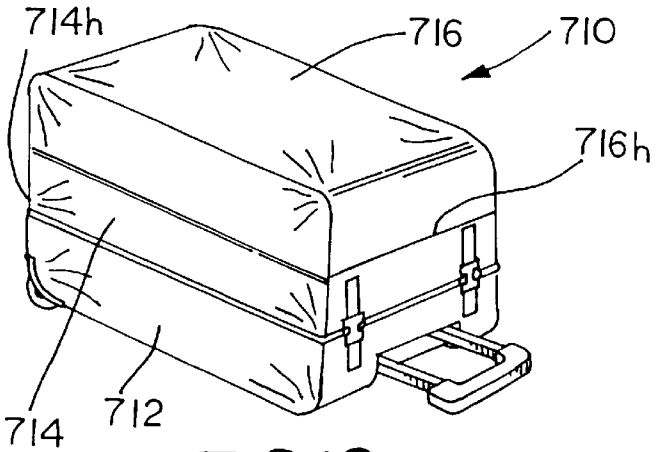
FIG. 18 is a perspective view of a soft-sided carrying case assembled in accordance with the teachings of an eighth preferred embodiment of the invention.
Figure 19:
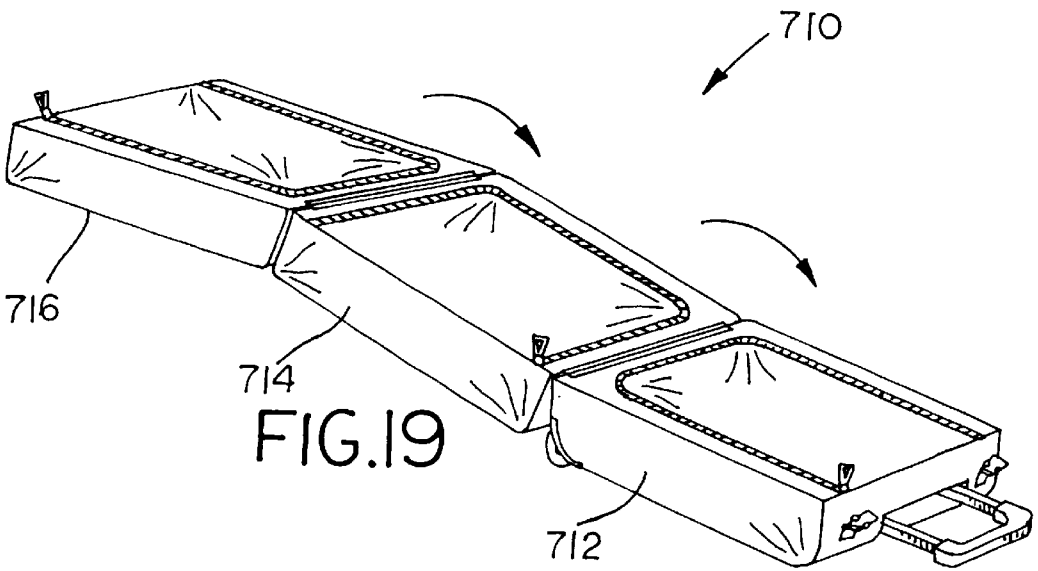
FIG. 19 is a perspective view of the device of FIG. 18 but illustrating the upper compartments in the unfolded positions.
Figure 21:
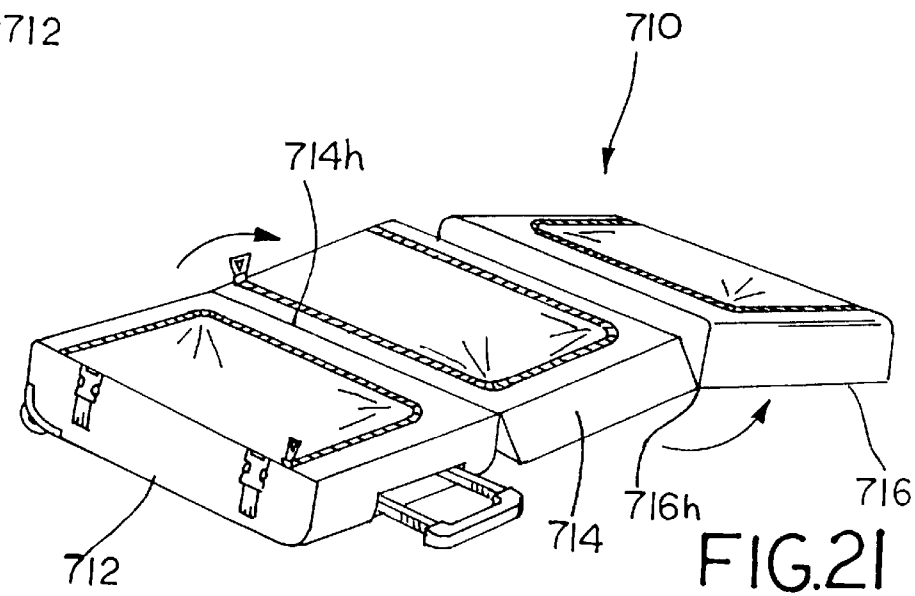
FIG. 21 is a perspective view of the device of FIG. 20 but illustrating the upper compartments in the unfolded positions.
Figure 20:
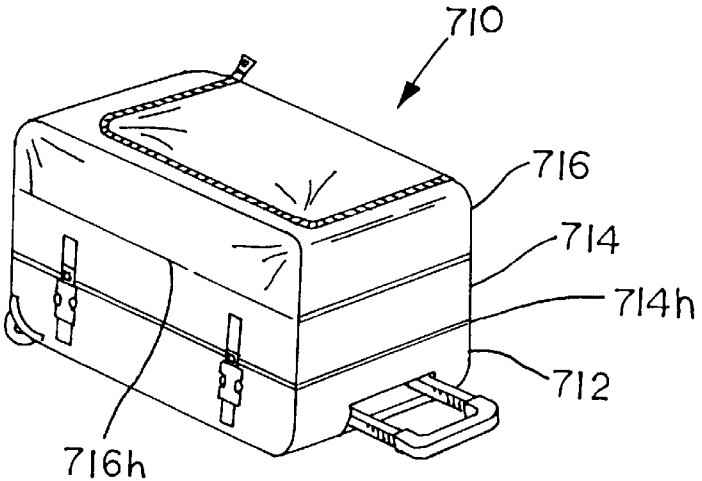
FIG. 20 is a perspective view of a soft-sided carrying case assembled in accordance with the teachings of a ninth preferred embodiment of the invention.

Referring now to FIGS. 15 and 16, a soft-sided carrying case assembled in accordance with the teachings of a sixth preferred embodiment of the invention is generally referred to by the reference numeral 610. For ease of reference, all elements that are the same or similar to the elements described above with respect to the first embodiment will retain the same reference numerals, but which have been increased by 600. The soft-sided carrying case 610 generally includes four sidewalls 610*a*, 610*b*, 610*c*, and 610*d*, a bottom wall 610*e* and a top wall 610*f*. The case 610 further includes a lower compartment 612 and three upper compartments 614, 615, and 616. The lower compartment 612 includes a plurality of sidewalls 612*a*. The lower compartment 612 also includes a bottom wall 612*e* and a top wall 612*f* (FIG. 16).

Each of the upper compartments 614, 615, and 616 includes a plurality of sidewalls, a top wall and a bottom wall. As shown in FIG. 16, all three compartments 614, 615, and 616 are pivotally joined to the lower compartment 612 by hinges 614*g*, 615*g*, and 616*g*, respectively, disposed along an interface 618. Thus, all three of the upper compartments 614, 615, and 616 are shiftable between the folded positions (i.e., with the upper compartments 614, 615, and/or 616 disposed above the lower compartment 612) and the open or unfolded positions shown in FIG. 16.

Figure 17:
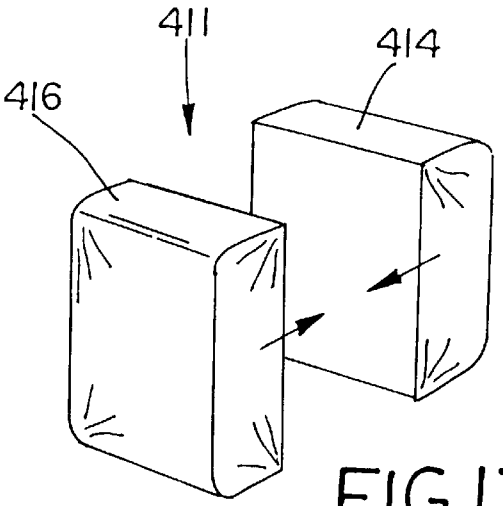
FIG. 17 is a perspective view of two of the upper compartments that have been separated from the balance of the soft-sided carrying case of any of the previously shown embodiments and which are being shown being attached to each other to form an additional smaller soft-sided carrying case.

FIG. 17 illustrates the manner by which any of the upper compartments of the previously mentioned embodiments (for example, the upper compartments 414 and 416 of the embodiment of FIGS. 11 and 12) may be removed from the case and may be joined together to form a second, smaller carrying case 411. A handle (not shown) may be provided.

FIGS. 18–21 illustrate two different configurations for a tri-fold soft-sided carrying case assembled in accordance with the teachings of still further embodiments of the present invention, each designated as 710. The cases 710 shown therein each include a lower compartment 712 and pair of upper compartments 714 and 716. It will be noted that the hinge lines 714*h* and 716*h* are in different planes when the cases 710 are in the folded positions of FIGS. 18 and 20. The remainder of the cases shown therein may be constructed in accordance with the teachings of the above-described embodiments.

Figures 22, 23:
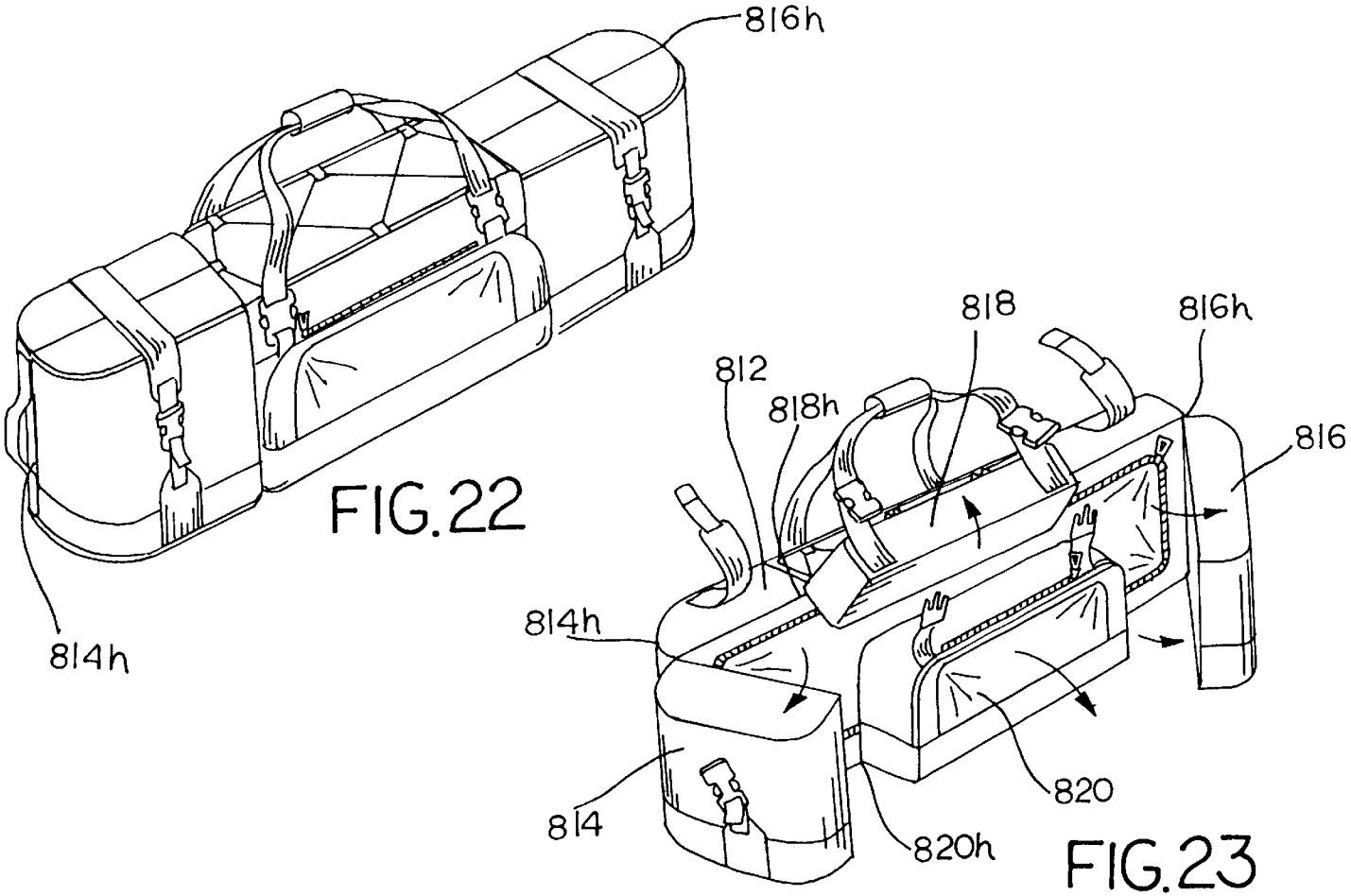
FIG. 22 is a perspective view of a soft-sided carrying case assembled in accordance with the teachings of a tenth preferred embodiment of the invention.
FIG. 23 is a perspective view of the device of FIG. 22 but illustrating the upper compartments in partially unfolded positions.

FIGS. 22 and 23 illustrate a soft-sided carrying case 810 having a plurality of compartments 812, 814, 816, 818, and

820. The compartments 814 and 816 pivot about vertical hinge lines 814*h* and 816*h*, while the compartment 818 may pivot about a horizontal hinge line 818*h* (FIG. 23). The compartment 820 my be removable as shown in FIG. 23, or may pivot about a hinge line 820*h* (FIG. 23).

Figure 24:
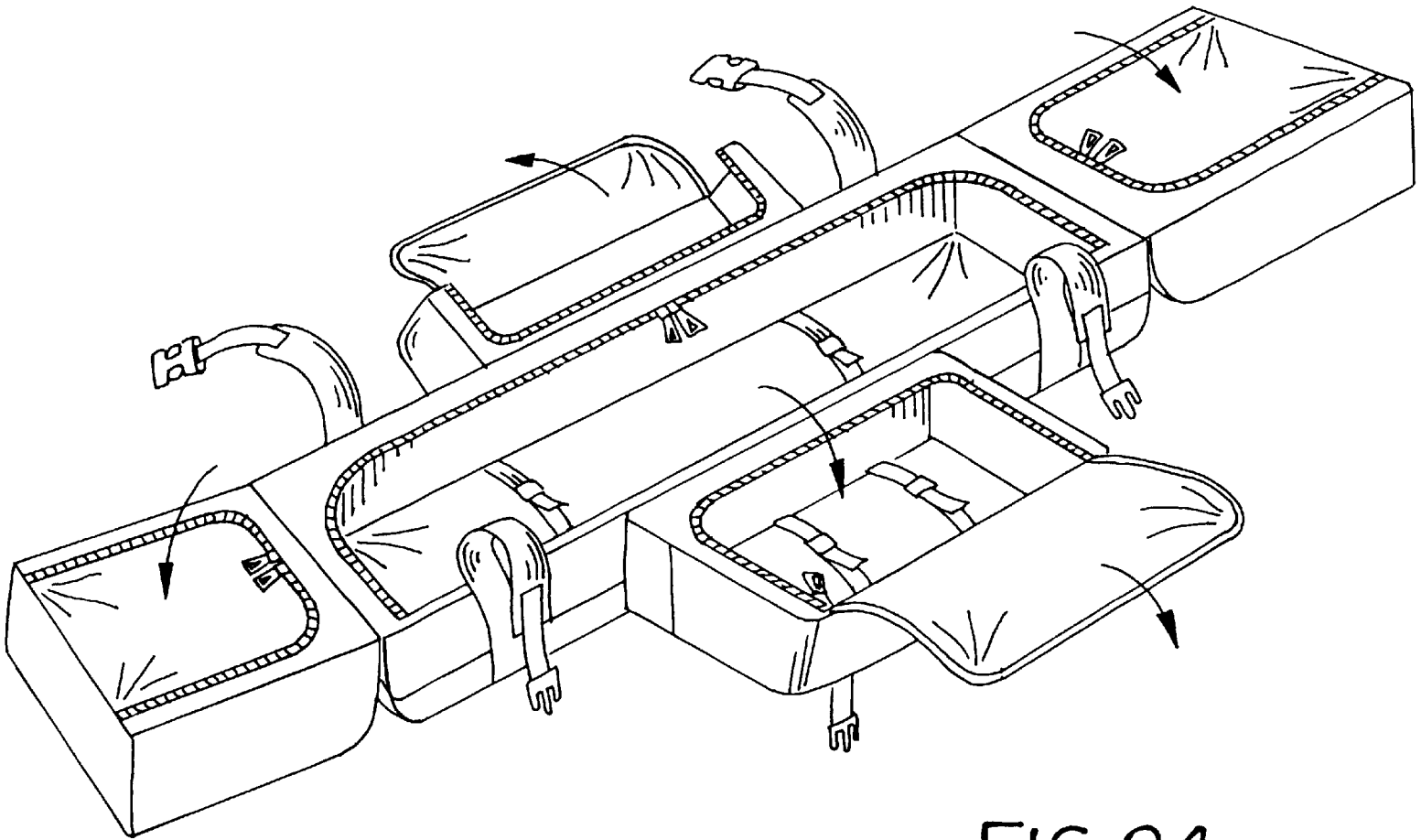
FIG. 24 is a perspective view similar to FIG. 23 but illustrating the upper compartments in more fully unfolded positions.
Figures 25, 26:
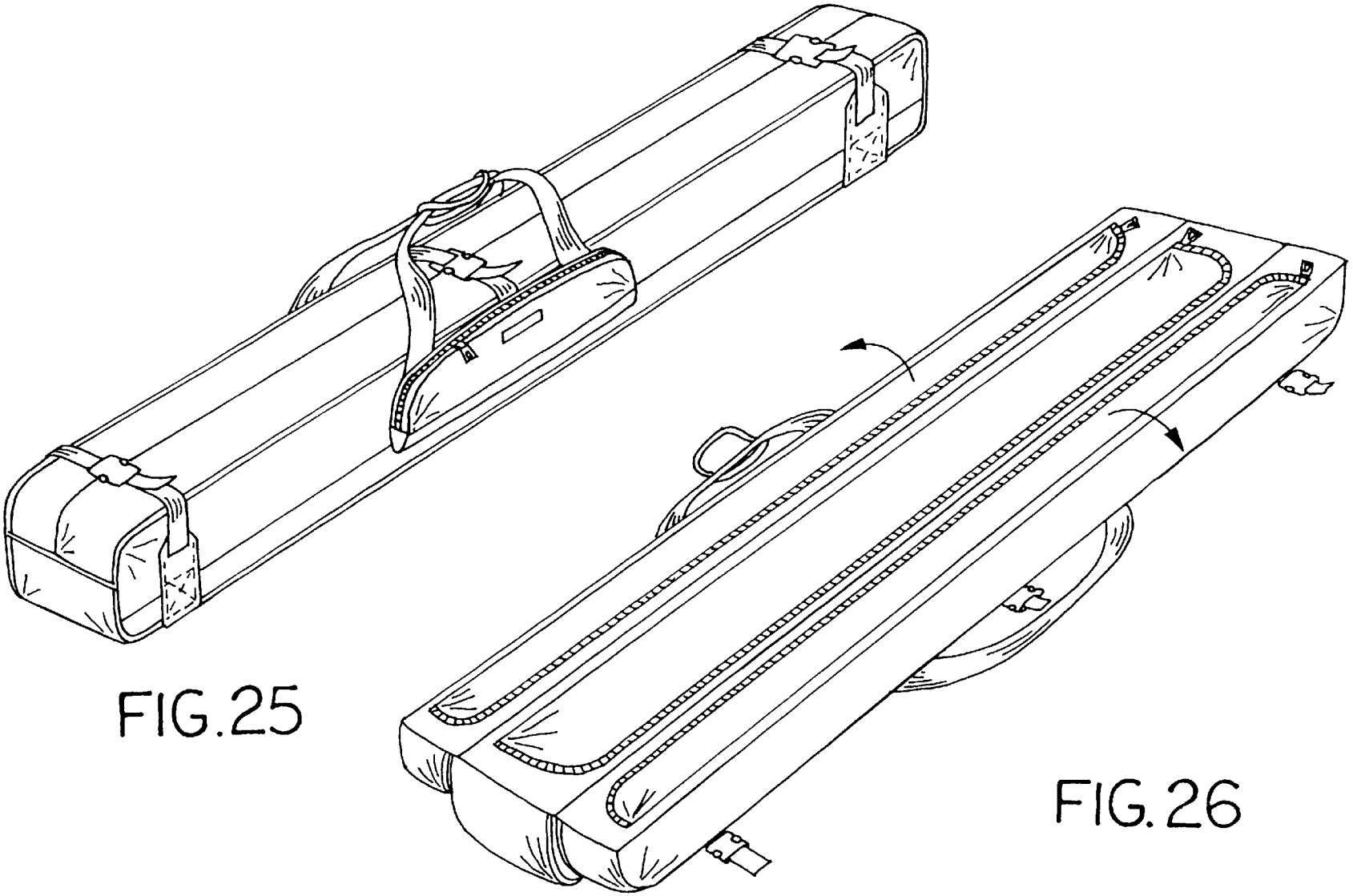
FIG. 25 is a perspective view of a soft-sided carrying case assembled in accordance with the teachings of yet another preferred embodiment of the invention.
FIG. 26 is a perspective view of the device of FIG. 2 but illustrating the upper compartments in unfolded positions.

FIGS. 24–26 illustrate two additional embodiments incorporating the teachings of the present invention.

Although certain exemplary embodiments constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed:

1. A soft-sided carrying case comprising:

a primary compartment, the primary compartment including a plurality of sidewalls, a top wall and a bottom wall, a first one of the sidewalls and a second one of the sidewalls each including an extended portion;

a first upper compartment, the first upper compartment having a plurality of sidewalls, a top wall, and a bottom wall, one of the sidewalls of the first upper compartment being contiguous with and formed by the extended portion of the first sidewall of the primary compartment, the extended portion of the first sidewall defining a first hinge line generally adjacent to an interface defined between the primary compartment and the first upper compartment, the first hinge line permitting the first upper compartment to pivot about the first hinge line between a folded position and an unfolded position; and a second upper compartment, the second upper compartment having a plurality of sidewalls, a top wall, and a bottom wall, one of the sidewalls of the second upper compartment being contiguous with and formed by the extended portion of the second sidewall of the primary compartment, the extended portion of the second sidewall defining a second hinge line generally adjacent to an interface defined between the primary compartment and the second upper compartment, the second hinge line permitting the second upper compartment to pivot about the second hinge line between a folded position and an unfolded position;

the carrying case including a pair of wheels and an extendable handle; and wherein the carrying case includes at least one extendable cord having a portion adapted for securement to the extendable handle, the cord and the handle cooperating to define a space sized to receive a parcel.

2. The soft-sided carrying case of claim 1, including a releasable closure engaging the first and second upper compartments for maintaining the first and second upper compartments in their respective closed positions.

3. The soft-sided carrying case of claim 2, wherein the closure includes at least one strap.

4. The soft-sided carrying case of claim 3, wherein the strap includes a releasable fastener.

5. The soft-sided carrying case of claim 1, wherein the primary compartment includes a closing flap.

6. The soft sided carrying case of claim 5, wherein the closing flap is secured in a closed position by a releasable fastener.

7. The soft sided carrying case of 1, claim wherein the primary compartment includes a top wall, and wherein each of the upper compartments includes a closing flap, at least a portion of the closing flap of each upper compartment being disposed in confronting relationship with the top wall of the primary compartment when the respective upper compartment is in the folded position, and further wherein the first and second hinge lines are adapted such that the closing flap of each upper compartment and the top wall of the primary compartment are disposed in a common plane when the respective upper compartments are in the unfolded position.

8. The soft sided carrying case of claim 7, wherein the closing flap of each of the upper compartments is secured in a closed position by a fastener.

9. The soft-sided carrying case of claim 7, wherein the closing flap of each of the upper compartments is defined at least in part by the bottom wall of the respective upper compartment.

10. A soft-sided carrying case comprising:

a lower compartment, the lower compartment including a plurality of sidewalls, a top wall and a bottom wall;

a first upper compartment, the first upper compartment having a plurality of sidewalls, a top wall, and a bottom wall;

a first hinge pivotally joining the first upper compartment to the lower compartment along a first hinge line, the first hinge permitting the first upper compartment to pivot about the first hinge line between a folded position and an unfolded position;

a second upper compartment, the second upper compartment having a plurality of sidewalls, a top wall, and a bottom wall;

a second hinge pivotally joining the second upper compartment to the lower compartment along a second hinge line, the second hinge permitting the second upper compartment to pivot about the second hinge line between a folded position and an unfolded position;

a plurality of wheels; and an extendable handle;

and wherein the carrying case includes at least one extendable cord, the extendable cord having a portion adapted for securement to the extendable handle, the extendable cord and the handle cooperating to define a space sized to receive a parcel.

11. The soft-sided carrying case of claim 10, including a closure mechanism engaging the first and second upper compartments for maintaining the first and second upper compartments in their respective closed positions.

12. The soft-sided carrying case of claim 11, wherein the closure mechanism includes a releasable fastener.

13. The soft-sided carrying case of claim 10, wherein the lower compartment and the first and second upper compartments each include includes a closing flap.

14. The soft-sided carrying case of claim 13, wherein each of the closing flaps are secured in a closed position by a releasable fastener.

15. The soft-sided carrying case of claim 12, wherein a first sidewall of the lower compartment includes an extended portion that extends to form at least a portion of a first sidewall of the first upper compartment, and wherein a second sidewall of the lower compartment includes an extended portion that extends to form at least a portion of a first sidewall of the second upper compartment, and wherein the first hinge and the second hinge are defined exclusively by the extended portions of the first sidewall and the second sidewall, respectively.

* * * * *

UNITED STATES PATENT AND TRADEMARK OFFICE

CERTIFICATE OF CORRECTION

PATENT NO. : 6,644,448 B2
DATED : November 11, 2003
INVENTOR(S) : L.H. Bernbaum et al.

It is certified that error appears in the above-identified patent and that said Letters Patent is hereby corrected as shown below:

Column 12,
Line 1, delete “1, claim” and insert instead -- claim 1, --.
Lines 2-3, delete “each include includes a” and insert -- each include a --.

Signed and Sealed this

Third Day of August, 2004

JON W. DUDAS
*Acting Director of the United States Patent and Trademark Office*